US005202601A

United States Patent [19]

Takamura et al.

[11] Patent Number: 5,202,601

[45] Date of Patent: Apr. 13, 1993

[54] SPARK PLUG FOR INTERNAL COMBUSTION ENGINE WITH RECESS IN ELECTRODE TIP

[75] Inventors: Kozo Takamura, Nagoya; Yasuyuki Sato, Kasugai; Kiyoaki Tanaka, Numazu, all of Japan

[73] Assignee: Nippondenso Co., Ltd., Kariya, Japan

[21] Appl. No.: 634,351

[22] Filed: Dec. 26, 1990

[30] Foreign Application Priority Data

| | | | |
|---|---|---|---|
| Dec. 27, 1989 | [JP] | Japan | 1-343737 |
| Dec. 27, 1989 | [JP] | Japan | 1-343738 |
| Jun. 5, 1990 | [JP] | Japan | 2-147997 |
| Nov. 14, 1990 | [JP] | Japan | 2-310094 |

[51] Int. Cl.[5] ..... H01T 13/20

[52] U.S. Cl. ..... 313/142; 313/11.5

[58] Field of Search ..... 313/11.5, 141, 142

[56] References Cited

U.S. PATENT DOCUMENTS

| | | | |
|---|---|---|---|
| 1,307,176 | 6/1919 | Benn | 313/141 |
| 2,421,790 | 6/1947 | Korman | 313/141 |
| 4,336,477 | 6/1982 | Yamada . | |
| 4,540,910 | 9/1985 | Kondo et al. . | |
| 4,581,558 | 4/1986 | Takamura et al. . | |

FOREIGN PATENT DOCUMENTS

| | | |
|---|---|---|
| 57-145288 | 9/1982 | Japan . |
| 59-33949 | 8/1984 | Japan . |

*Primary Examiner*—Donald J. Yusko
*Assistant Examiner*—John Giust
*Attorney, Agent, or Firm*—Cushman, Darby & Cushman

[57] ABSTRACT

A spark plug for use in an internal combustion engine comprises a central electrode made of a base metal and an earth electrode. A tip portion is provided on the central electrode. The tip portion includes a noble metal tip layer for defining a spark discharge gap between the noble metal tip layer and the earth electrode, and an alloy layer provided between the noble metal tip layer and the central electrode. The tip portion is provided with grooves to be divided into a plurality of sections. The tip portion has an outer peripheral wall flared towards the earth electrode, and a width of the grooves gradually increases from a bottom thereof to a surface of the noble metal tip layer for defining the spark discharge gap.

33 Claims, 21 Drawing Sheets

FIG. 25

| THICKNESS C OF ALLOY LAYER | THICKNESS B OF NOBLE METAL TIP LAYER | | | RELATION BETWEEN GROOVE DEPTH A AND THICKNESS B |
|---|---|---|---|---|
| | B = 0.2mm | B = 0.5mm | B = 1.0mm | |
| 0mm < C < 0.01mm | 0.14mm ≤ A ≤ 0.53mm | 0.33mm ≤ A ≤ 0.83mm | 0.63mm ≤ A ≤ 1.30mm | $\frac{2}{3}B \leq A \leq B + 0.3$(mm) |
| C = 0.01mm | 0.13mm ≤ A ≤ 0.93mm | 0.35mm ≤ A ≤ 1.23mm | 0.65mm ≤ A ≤ 1.70mm | $\frac{2}{3}B \leq A \leq B + 0.7$(mm) |
| C = 0.05mm | 0.13mm ≤ A ≤ 1.00mm | 0.33mm ≤ A ≤ 1.30mm | 0.63mm ≤ A ≤ 1.80mm | $\frac{2}{3}B \leq A \leq B + 0.8$(mm) |
| C = 0.20mm | | 0.30mm ≤ A ≤ 1.40mm | 0.65mm ≤ A ≤ 1.90mm | $\frac{2}{3}B \leq A \leq B + 0.9$(mm) |

XXIXB
XXIXB
19
1

XXIXD
XXIXD
12
19
1

22
12
19
1

22
19
1

XXIXH
XXIXH
12
19
1

SPARK PLUG FOR INTERNAL COMBUSTION ENGINE WITH RECESS IN ELECTRODE TIP

BACKGROUND OF THE INVENTION

This invention relates to a spark plug for an internal combustion engine used in an automobile or the like.

A spark plug is used in a petrol internal combustion engine for an automobile. There have heretofore been proposed various spark plugs having a noble metal tip layer (made, for example, of a platinum alloy) provided on a discharge portion of at least one of a central electrode and an earth electrode so as to achieve a long service life of the spark plug. At present, with the use of such platinum alloy tip layer, the service life of the spark plug has been prolonged to such an extent as to enable a 100,000 km running of an automobile. Recently, however, the number of parts attached to the engine has been increased because of a high-performance design of the engine, and therefore much time is required for exchanging the plug in the market. In order to prolong an exchange interval, there has now been a demand for the type of spark plug having a longer service life. This requirement can be met by increasing the amount of the platinum alloy, and there are two methods of increasing the platinum alloy amount. One is to increase the thickness of the platinum alloy tip layer, and the other is to increase the diameter of the platinum alloy tip layer.

With the method of increasing the thickness of the platinum alloy tip layer, however, when the service life expires (that is, the platinum alloy tip layer is completely consumed), the spark gap becomes greater, which leads to a possibility that a discharge may not be produced between the central electrode and the earth electrode. For this reason, this method is not practical. Therefore, to achieve a longer service life, it is necessary to increase the diameter of the platinum alloy tip layer. However, when this is done, a thermal stress at the surface of bonding between the platinum alloy tip layer and the substrate increases because of a difference in linear expansion coefficient between the platinum alloy tip layer and the substrate. As a result, the oxidation of the bonding surface between the platinum alloy tip layer and the substrate proceeds, and finally the platinum alloy tip layer becomes disengaged from the substrate. Therefore, at present, in order to achieve a long service life enabling the running of more than 100,000 km, the thermal stress must be decreased.

In order to decrease such thermal stress, it is effective to provide a stress-relieving layer between the platinum alloy tip layer and the substrate. More specifically, an alloy layer is formed at the bonding surface by a heat treatment, as disclosed in U.S. Pat. No. 4,581,558. Alternatively, as disclosed in U.S. Pat. No. 4,540,910, a stress-relieving layer of a material having a linear expansion coefficient between those of the platinum alloy tip layer and the substrate is formed between the platinum alloy tip layer and the substrate.

However, for example, if the plug is intended to achieve a service life enabling the running of 20,000 km which is twice that now attainable, it is necessary to double the area of the platinum alloy tip layer at the discharge surface, in which case the area of the bonding of the platinum alloy tip layer is doubled, and its diameter is about 1.4 times greater. Therefore, even if only the stress-relieving layer as disclosed in the above U. S. patents is provided, the platinum alloy tip layer may become disengaged, and therefore the thermal stress need to be decreased to a greater extent.

SUMMARY OF THE INVENTION

It is an object of this invention to provide a spark plug of the type in which the diameter of a noble metal tip layer is increased so as to prolong the service life of the spark plug, and a thermal stress at the tip layer-bonding surface is decreased so as to prevent the disengagement of the noble metal tip layer.

Another object of the invention is to provide a spark plug with a noble metal tip layer, in which a required voltage for a spark is lowered, and the ignitability is excellent.

The above first object has been achieved by dividing a noble metal tip portion by a recess substantially into a plurality of sections spaced from one another and disposed adjacent to one another. In this case, the noble metal tip portion can be composed of a thermal stress-relieving layer and a noble metal tip layer.

The above second object has been achieved by enlarging the width of the open end of the recess dividing the noble metal tip portion into the plurality of sections.

BRIEF DESCRIPTION OF THE DRAWINGS

FIG. 25 is a table showing results of various tests;

DESCRIPTION OF THE PREFERRED EMBODIMENTS

Examples of the invention each embodied in a spark plug for an automobile petrol engine will now be described with reference to the drawings.

First Embodiment

Figure 1:
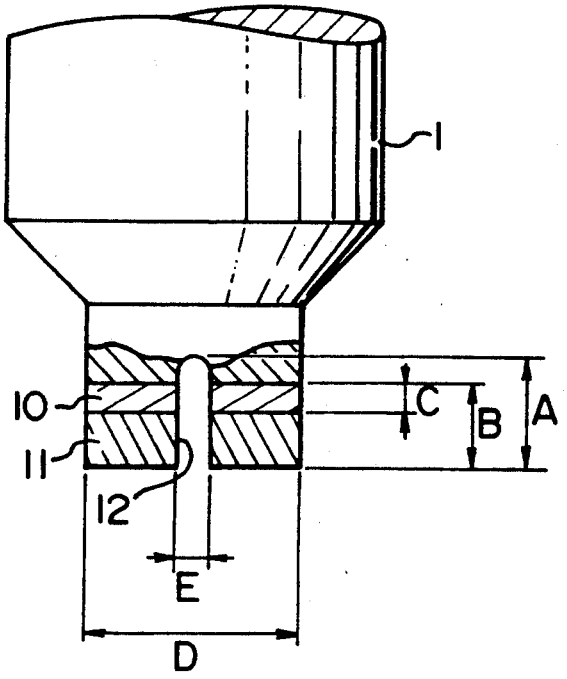
FIG. 1 is a fragmentary view of a distal end portion of a central electrode of a spark plug for an internal combustion engine in accordance with a first embodiment of the invention.
Figure 2:
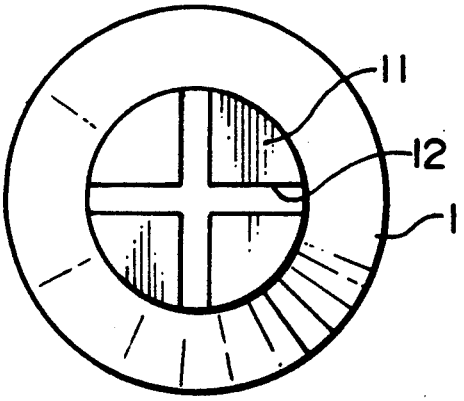
FIG. 2 is a bottom view of the central electrode.
Figure 3:
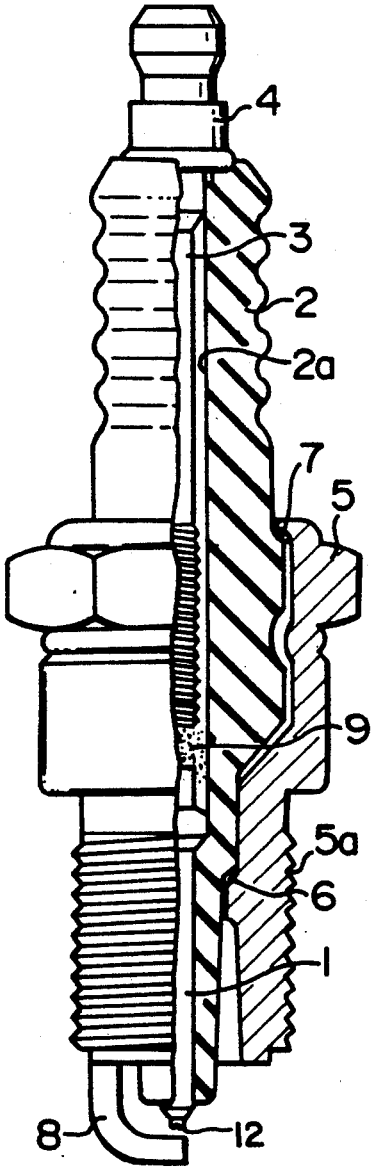
FIG. 3 is a view showing the overall construction of the shark plug.
Figure 4:
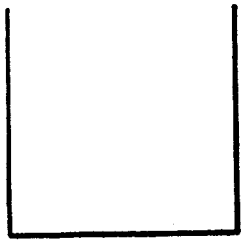
FIGS. 4, 5, 6 and 7 are views showing a process for forming a stress-relieving layer.
Figure 5:
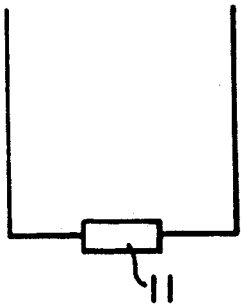
Figure 6:
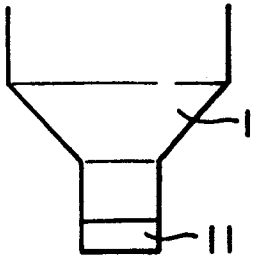
Figure 7:
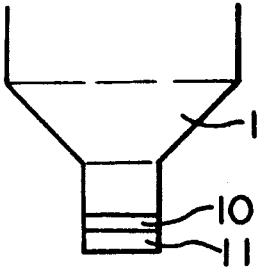
Figure 8:
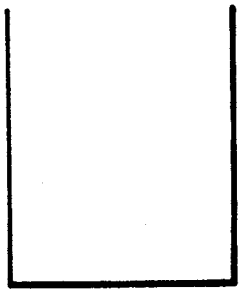
FIGS. 8, 9, 10 and 11 are views each showing another process for forming a stress-relieving layer.
Figure 9:
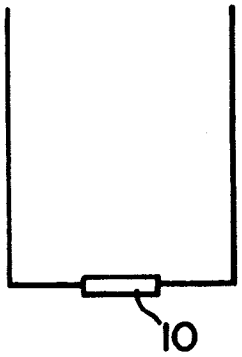
Figure 10:
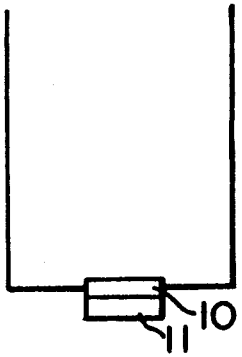
Figure 11:
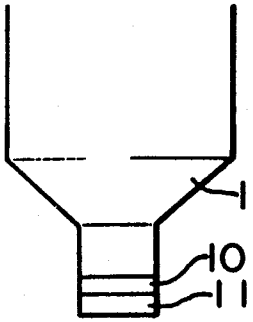

Referring to FIGS. 1 to 3, a spark plug includes a central electrode 1 made of base metal having heat resistance, corrosion resistance and electrical conductivity, such as Ni-type alloy. The central electrode 1 is retained in a lower portion of an axial bore 2*a* of an insulator 2. A central stem 3 of carbon steel is received in an upper portion of the axial hole 2*a* of the insulator 2. A terminal 4 of brass or the like is fixedly screw-mounted on a head of the central stem 3. The insulator 2 is received and secured in a cylindrical housing 5 through a ring-shaped sealing packing 6 and a clamping ring 7. The housing 5 is made of metal having heat resistance, corrosion resistance and electrical conductivity. The housing 5 has a threaded portion 5*a* through which the plug is fixed to an engine block.

An earth electrode 8 is fixedly secured to the lower end surface of the housing 5 by welding. The earth electrode 8 is made of metal having heat resistance, corrosion resistance and electrical conductivity. An electrically-conductive glass sealing layer 9 is provided in the axial bore 2*a* of the insulator 2 to electrically and mechanically connect the central stem 3 and the central electrode 1. This electrically-conductive glass sealing layer 9 is made of copper powder and low-melting glass.

As shown in FIG. 1, a noble metal tip layer 11 is welded to the distal end of the central electrode 1 through a stress-relieving layer 10 to form a discharge portion. A groove 12 is formed in the noble metal tip layer 11, and the groove 12 has a cross-shape as shown in FIG. 2.

The stress-relieving layer 10 is made of either a layer of an alloy of the base metal of the central electrode 1 and the noble metal of the tip layer 11 or a layer having a linear expansion coefficient between the linear expansion coefficient of the central electrode 1 and the linear expansion coefficient of the noble metal tip layer 11. More specifically, in the case of using the alloy layer, this is produced in a manner shown in FIGS. 4 to 7. First, the noble metal (Pt-20Ir) tip layer 11 is resistance-welded to the distal end face of the cylindrical member of Inconel 600 (nickel-chromium type alloy), and then the cylindrical member is shaped into the central electrode 1. Thereafter, the central electrode 1 having the noble metal tip layer 11 is held in a furnace at 900° C. for a predetermined period of time, so that the alloy layer serving as the stress-relieving layer 10 is formed.

In the case of the stress-relieving layer 10 made of the material having the above-mentioned intermediate expansion coefficient, this is produced in a manner shown in FIGS. 8 to 11. First, the stress-relieving layer 10 of Pt-20Ni (expansion coefficient: $11\times10^{-6}$) having a predetermined thickness is resistance-welded to the distal end face of the cylindrical member of Inconel 600 (expansion coefficient: $13.3\times10^{-6}$). The noble metal tip layer of Pt-20Ir (expansion coefficient: $8.9\times10^{-6}$) is resistance-welded to the surface of the stress-relieving layer 10, and then the cylindrical member is shaped into the central electrode 1.

Specific characteristics of the oxidation of the bonding surface of the noble metal tip layer 11 in connection with a depth of the groove 12 will now be described.

Figure 12:
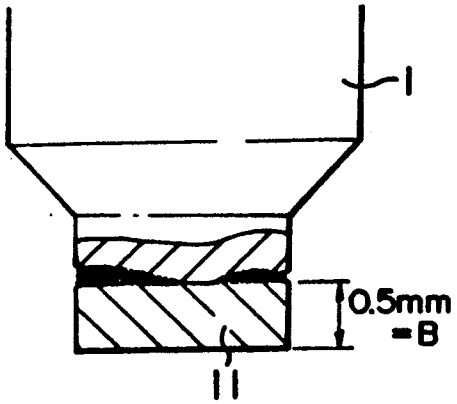
FIGS. 12, 13, 14, 15, 16, 17, 18, 19 and 20 are views each showing an oxidation condition of a bonding surface.
Figure 13:
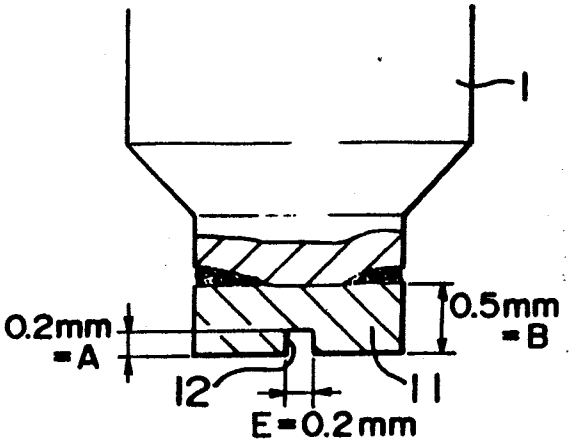
Figure 14:
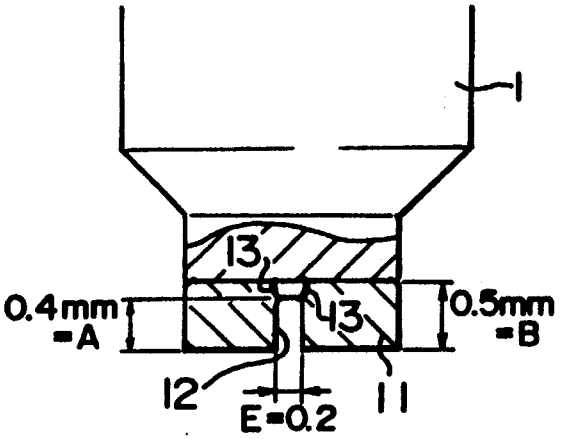
Figure 15:
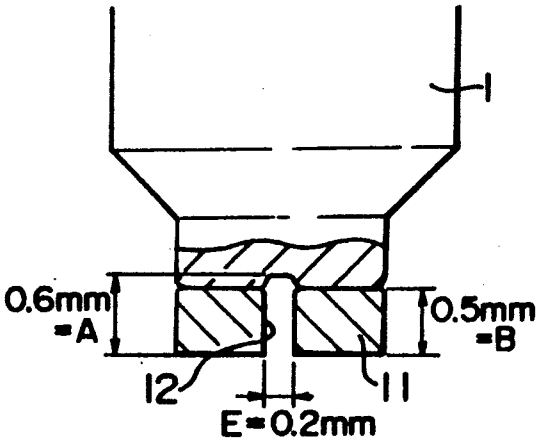
Figure 16:
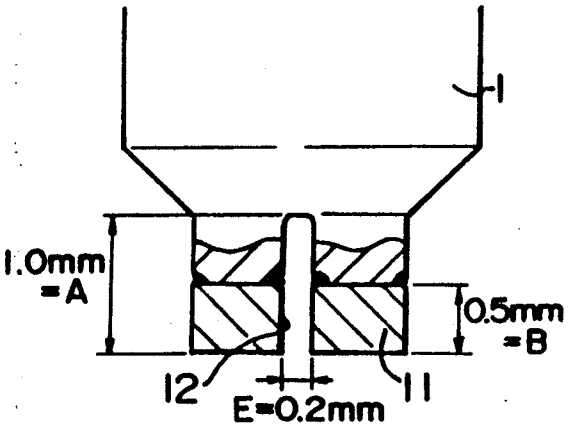

Referring to FIG. 1, here, the depth of the groove 12 in the axial direction of the spark plug is A mm, and the thickness of the noble metal tip layer 11 including the thickness of the stress-relieving layer 10 is B mm, and the thickness of the stress-relieving layer 10 is C mm. Inconel 600 is used to form the central electrode 1, and a platinum alloy tip (Pt-20Ir) is used to form the noble metal tip layer 11, and the central electrode 1 had a diameter D of 1.8 mm which is greater than the diameter (1.0 mm) of a usually-used central electrode, and the thickness B of the noble metal tip layer 11 is 0.5 mm. Under these conditions, the following test spark plugs are prepared, which are shown in FIGS. 12 to 16, respectively:

(1) plug having no groove 12 (FIG. 12);

(2) plug wherein the groove 12 has a width E of 0.2 mm and a depth A of 0.2 mm (FIG. 13);

(3) plug wherein the groove 12 had a width E of 0.2 mm and a depth A of 0.4 mm (FIG. 14);

(4) plug wherein the groove 12 had a width E of 0.2 mm and a depth A of 0.6 mm (FIG. 15); and (5) plug wherein the groove 12 had a width E of 0.2 mm and a depth A of 1.0 mm (FIG. 16).

With respect to evaluations of those spark plugs, they are tested at a repeated cycle of one-minute idling and one-minute W.O.T. for 100 hours, using a water-cooled four-cycle engine with a displacement of 2000 cc.

As a result, the portions marked in dark in FIGS. 12 to 16 are oxidized at the bonding surface. In the plug (1) of FIG. 12, an extensive oxidation is recognized at the bonding surface of the noble metal tip layer 11. In the plug (2) of FIG. 13, an extensive oxidation is also recognized at the bonding surface of the noble metal tip layer 11, as in the plug (1) of FIG. 12. In the plug (3) of FIG. 14, there are produced cracks 13 extending from the bottom of the groove 12 to the bonding surface, thus breaking the noble metal tip layer 11; however, the oxidation of the bonding surface is very slight. In the plug (4) of FIG. 15, the oxidation of the bonding surface of the noble metal tip layer 11 is very slight. In the plug (5) of FIG. 16, an extensive oxidation is recognized at the bonding surface of the noble metal tip layer 11.

It will be appreciated from the above results that in the plugs having the noble metal tip layer 11 provided at the discharge portion, the oxidation of the bonding surface is made very slight by providing the groove having a specific depth, as seen in FIGS. 14 and 15.

Therefore, specific values which could make slight the oxidation of the bonding surface of the noble metal tip layer 11 by the provision of the groove 12 are evaluated based on various thicknesses of the stress-relieving layer 10 in view of the thickness of the noble metal tip layer and the depth of the groove.

The tests for the evaluations are carried out at a repeated cycle of one-minute idling and one-minute W.0.T. for 100 hours, using a water-cooled four-cycle engine with a displacement of 2000 cc. The results will now be described in detail.

Figure 17:
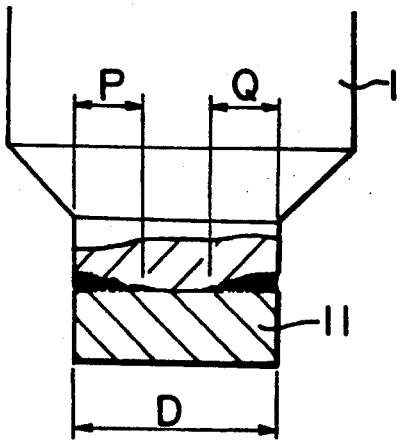
Figure 18:
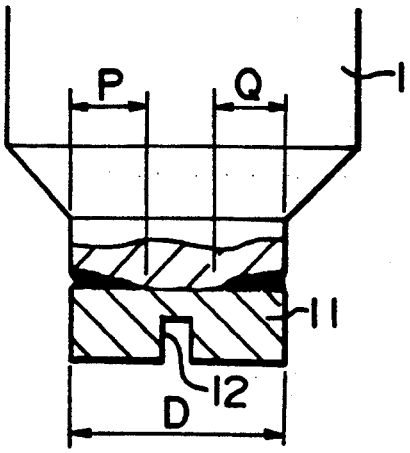
Figure 20:
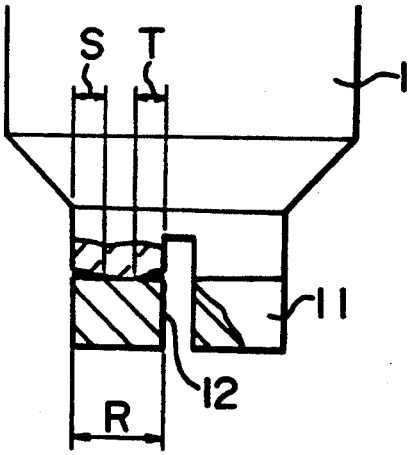

The standards for judgment of the oxidation of the bonding surface, adopted in this test, will be explained with reference to FIGS. 17 and 20. FIG. 17 shows a first case where no groove is provided, and the oxidation is extended by P mm and Q mm from the outer periphery of the bonding surface having a diameter of D mm. In this case, the degree of oxidation of the bonding surface is represented by (P+Q)/D. FIG. 18 shows a second case where a groove 12 is provided, and the bonding surface is oxidized as in FIG. 17. In this case, the degree of oxidation of the bonding surface is represented by (P+Q)/D.

Figure 19:
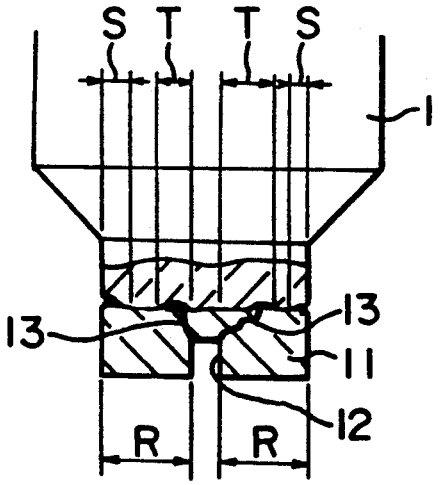

FIG. 19 shows a third case where a groove 12 is provided, and cracks 13 develop and extend from the bottom of the groove 12 to the bonding surface, and the bonding surface is oxidized. In this case, the degree of oxidation of the bonding surface is represented by (S+T)/R. FIG. 20 shows a fourth case where a groove 12 has a depth greater than the thickness of a noble metal tip layer 11. In this case, the degree of oxidation of the bonding surface is represented by (S+T)/R. It has been confirmed through tests that there is no problem in practical use when the above oxidation degree (P+Q)/D or (S+T)/R is not more than 0.25.

Figure 21:
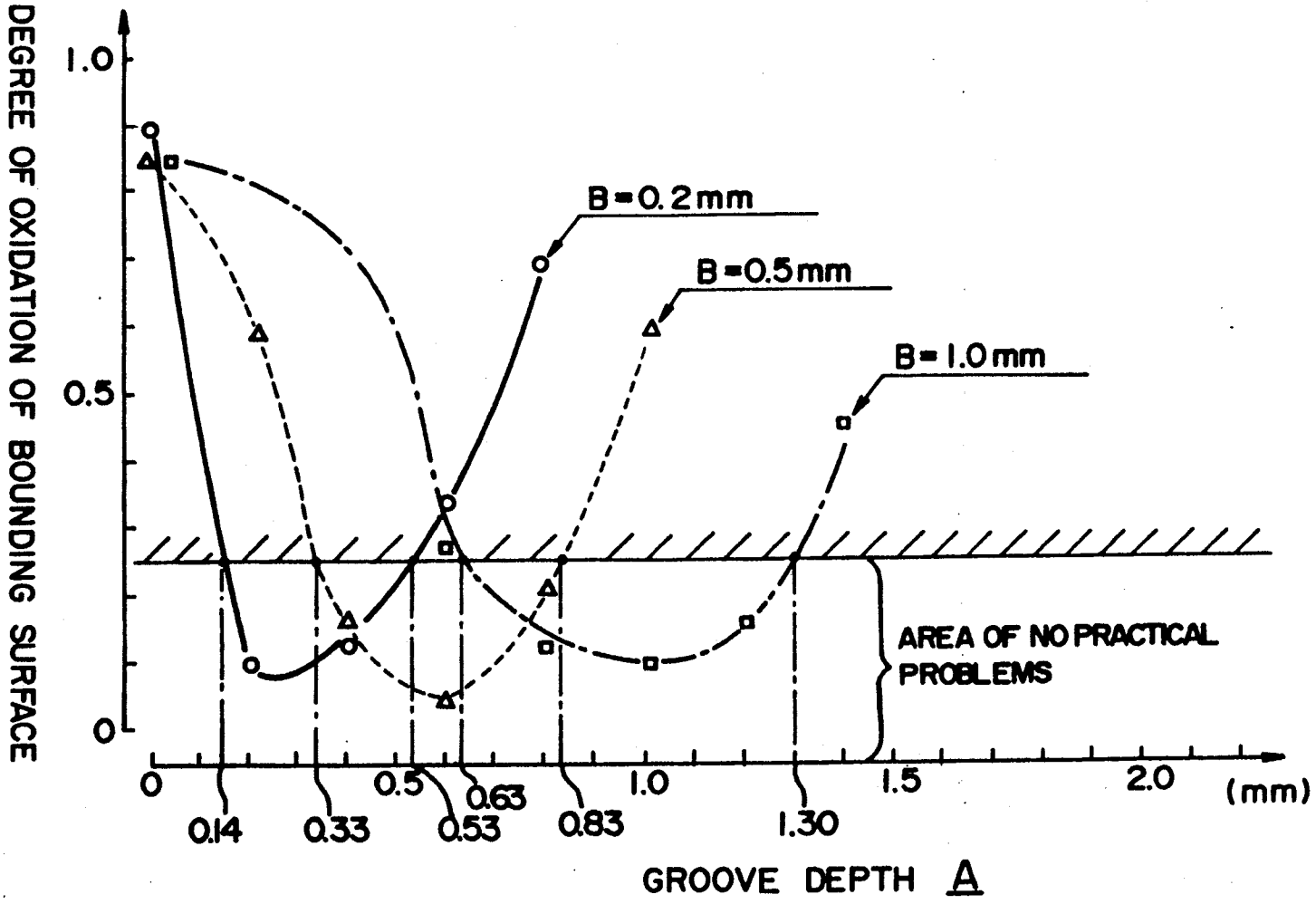
FIGS. 21, 22, 23, and 24 are graphs each showing the relation between a groove depth and the degree of oxidation of the bonding surface.

The evaluation results will be described in the following:

FIG. 21 shows data of the type of plugs in which a noble metal tip layer 11 is merely resistance-welded, and any treatment, such as a heat treatment, for forming an alloy layer that can serve as a stress-relieving layer, is not applied after the welding. The thickness C of an alloy layer formed by welding is usually about 0 to about 0.005 mm, and in rare cases this thickness is around 0.01 mm. In FIG. 21, the ordinate axis represents the degree of oxidation of the bonding surface, and the abscissa axis represents the groove depth A. With respect to the thickness B of the noble metal tip layer 11, the data in connection with a plug having the thickness B of 0.2 mm are indicated by ○, and the data in connection with a plug having the thickness B of 0.5 mm are indicated by Δ, and the data in connection with a plug having the thickness B of 1.0 mm are indicated by □. The diameter D of the noble metal tip layer 11 of each plug is constant, that is, 1.8 mm. It will be appreciated from FIG. 21 that the range of the groove depth A which makes the degree of oxidation of the bonding surface slight varies depending on the thickness B of the noble metal tip layer 11. As can be seen from FIG. 21, the range of the groove depth A which does not pose any problem in practical use in connection with the noble metal tip layer thickness B is as follows:

0.14 mm≦A≦0.53 mm in the case of the noble metal tip layer thickness B of 0.2 mm;

0.33 mm≦A≦0.83 mm in the case of the noble metal tip layer thickness B of 0.5 mm; and 0.63 mm≦A≦1.30 mm in the case of the noble metal tip layer thickness B of 1.0 mm.

Thus, it is preferred that the depth of the groove 12 should be generally equal to the noble metal tip layer thickness B. Namely, it is preferred that the bottom of the groove 12 should be disposed in the vicinity of the bonding surface of the noble metal tip layer 11. In view of the above values, when the noble metal tip layer thickness B and the groove depth A meet the following relation, e.g. 2B/3≦A≦B+0.3 mm, the oxidation of the bonding surface does not pose any problem in practical use.

Figure 22:
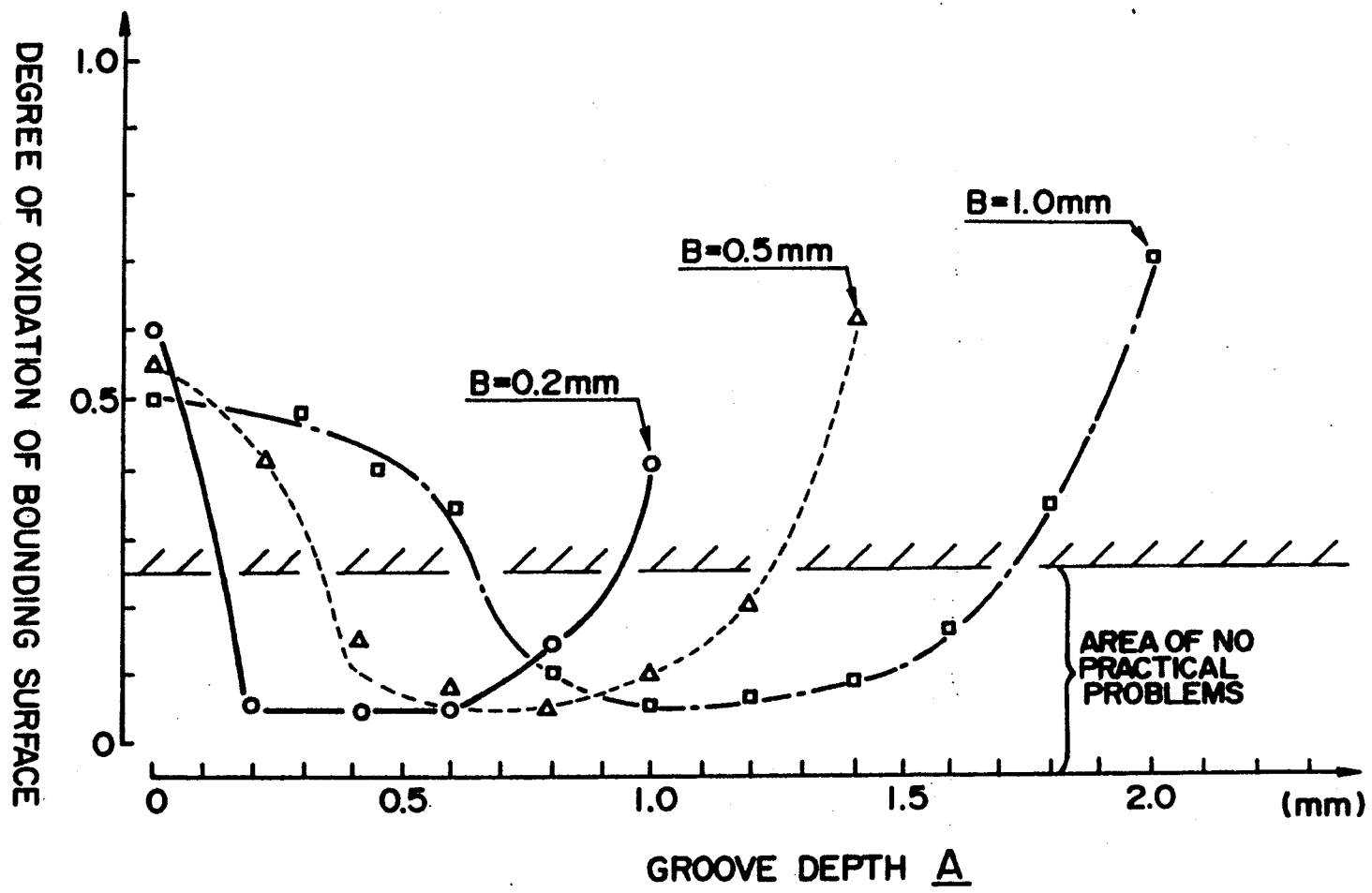

FIG. 22 show data of the type of plugs in which an alloy layer serving as a stress-relieving layer has a thickness C of 0.01 mm at which value thermal stress-reducing effects can begin to appear. The ordinate axis represents the degree of oxidation of the bonding surface, and the abscissa axis represents the groove depth A. With respect to the thickness B of the noble metal tip layer 11, the data in connection with a plug having the thickness B of 0.2 mm are indicated by ○, and the data in connection with a plug having the thickness B of 0.5 mm are indicated by Δ, and the data in connection with a plug having the thickness B of 1.0 mm are indicated by □. The diameter D of the noble metal tip layer 11 of each plug is constant, that is, 1.8 mm.

Figure 23:
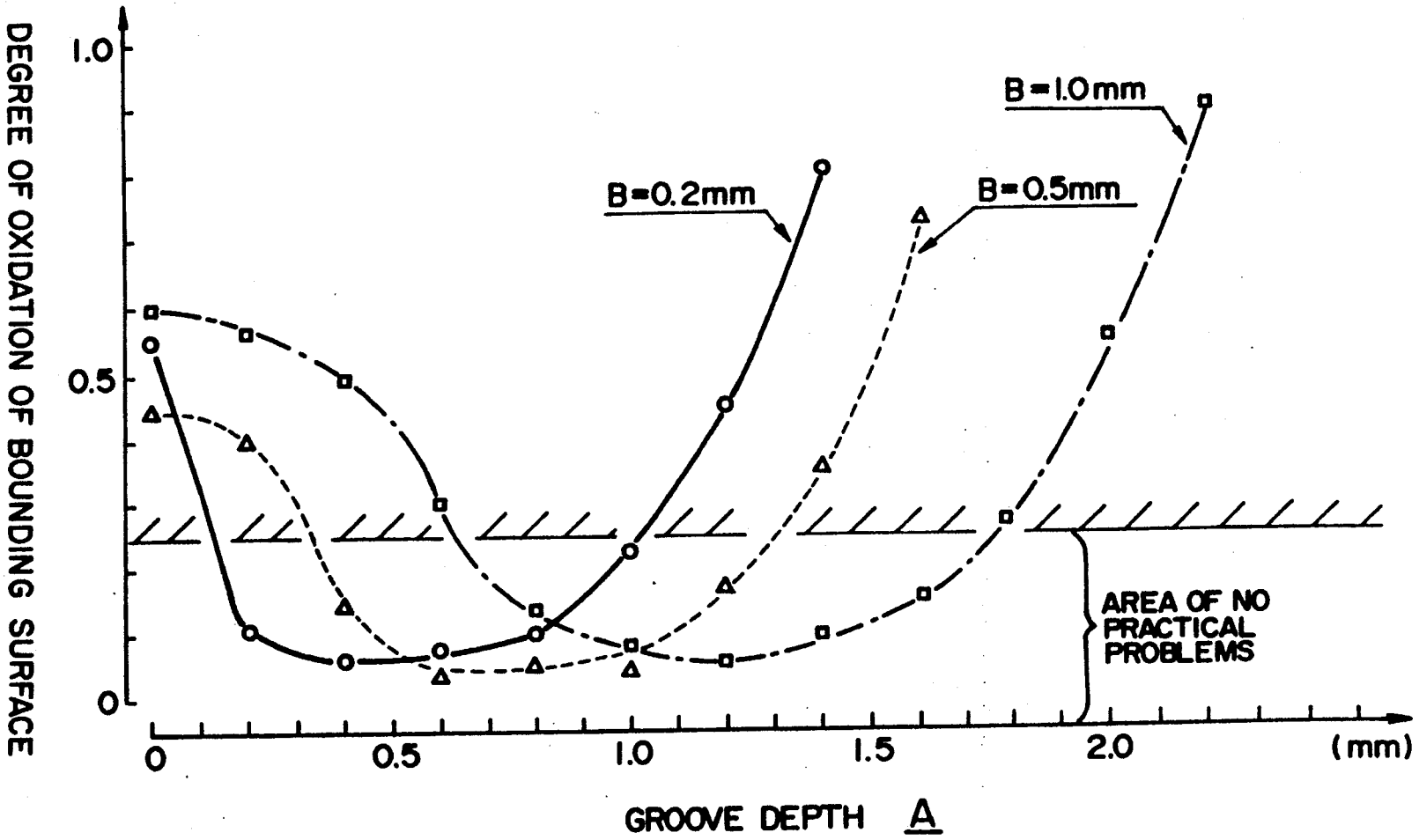

FIG. 23 show data of the type of plugs in which an alloy layer serving as a stress-relieving layer has a thickness C of 0.05 mm. The ordinate axis represents the degree of oxidation of the bonding surface, and the abscissa axis represents the groove depth A. With respect to the thickness B of the noble metal tip layer 11, the data in connection with a plug having the thickness B of 0.2 mm are indicated by ○, and the data in connection with a plug having the thickness B of 0.5 mm are indicated by Δ, and the data in connection with a plug having the thickness B of 1.0 mm are indicated by □. The diameter D of the noble metal tip layer 11 of each plug is constant, that is, 1.8 mm.

Figure 24:
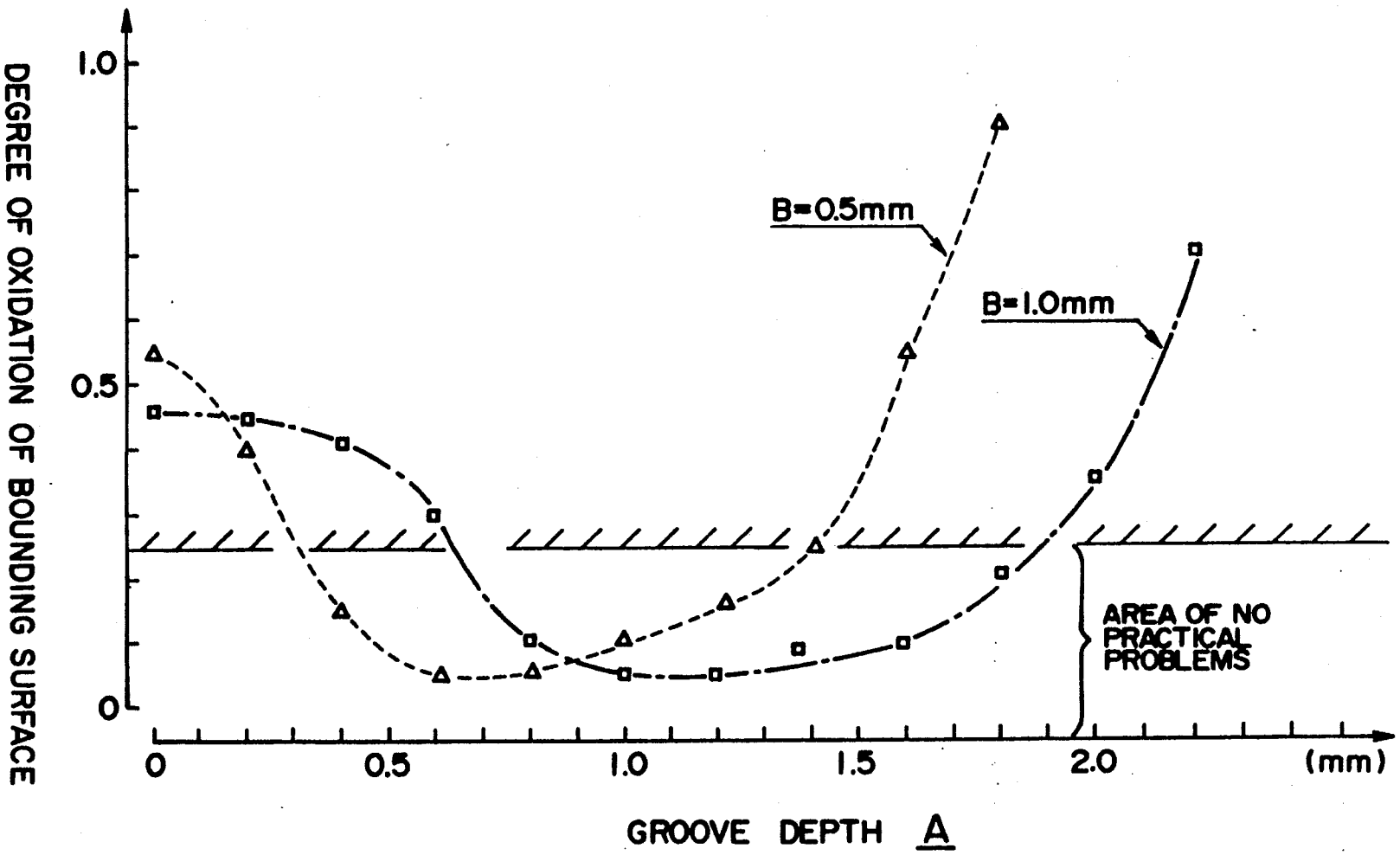

FIG. 24 show data of the type of plugs in which an alloy layer serving as a stress-relieving layer has a thickness C of 0.2 mm. The ordinate axis represents the degree of oxidation of the bonding surface, and the abscissa axis represents the groove depth A. With respect to the thickness B of the platinum alloy tip layer 11, the data in connection with a plug having the thickness B of 0.5 mm are indicated by Δ, and the data in connection with a plug having the thickness B of 1.0 mm are indicated by □. The diameter D of the noble metal tip layer 11 of each plug is constant, that is, 1.8 mm.

The table of FIG. 25 shows the ranges of the groove depth A which are shown in FIGS. 22, 23 and 24 and do not pose any problem in practical use in connection with the noble metal tip layer thickness B together with the results of FIG. 21. As shown in FIG. 25, in connection with the alloy layer thickness C, the relation between the noble metal tip layer thickness B and the groove depth A which does not pose any practical problem due to the oxidation of the bonding surface is as follows:

2B/3≦A≦B+0.3 mm in the case of 0<C<0.01 mm;

2B/3≦A≦B+0.7 mm in the case of 0.01 mm≦C<0.05 mm;

2B/3≦A≦B+0.8 mm in the case of 0.05 mm≦C<0.2 mm; and

2B/3≦A≦B+0.9 mm in the case of 0.2 mm≦C

It has been confirmed that even when the diameter D of the noble metal tip layer is 1.5 mm, the characteristics in FIGS. 21 to 24 are not changed.

As described above, only when the groove 12 of a specific depth is formed in the central electrode having the noble metal tip layer 11 at the discharge portion, the oxidation of the bonding surface is greatly suppressed. The reason for this will now be considered.

First, with respect to the groove depth A, when the diameter of the noble metal tip layer 11 is increased so as to achieve a longer service life as shown in FIG. 12, there is obtained an advantage that because of the increased bonding area, the temperature of the bonding surface can be easily lowered, so that the thermal stress can be decreased because of the area effect. At the same time, there is encountered a disadvantage that the thermal stress is increased because of the configuration effect. In this case, the oxidation of the bonding surface proceeds to a large degree, and the increase of the thermal stress due to the configuration effect has a greater influence than the decrease of the thermal stress due to the area effect has.

When the depth of the groove 12 is made slightly greater than the thickness B of the noble metal tip layer 11, as shown in FIG. 15, and also the diameter of the noble metal tip layer 11 is increased in order to achieve a longer service life, the noble metal tip layer 11 is divided into sections by the groove 12, and therefore the increase of the thermal stress due to the configuration effect does not occur, and the area effect can decrease the thermal stress, thereby greatly suppressing the oxidation of the bonding surface.

As shown in FIG. 14, when the depth of the groove 12 is made slightly smaller than the thickness B of the noble metal tip layer 11, the thermal stress of a degree similar to that in FIG. 12 is applied at an initial stage; however, before the bonding surface is oxidized by this thermal stress, the thermal stress concentrates on the groove 12 to form cracks 13 in the noble metal tip layer 11, so that the noble metal tip layer 11 is divided into sections as in FIG. 15. As a result, it is thought that the increase of the thermal stress due to the configuration effect does not occur, and the decrease of the thermal stress due to the area effect can be achieved, thereby greatly suppressing the oxidation of the bonding surface.

As shown in FIG. 13, when the groove 12 is very shallow, cracks 13 can not be formed in the groove 12 by the thermal stress, and the oxidation of the bonding surface proceeds to a large degree as in FIG. 12.

As shown in FIG. 16, when the groove 12 is very deep, the increase of the thermal stress does not occur, but the decrease of the thermal stress due to the area effect also does not occur. The central electrode portion is substantially narrowed by the groove 12, so that the temperature of the bonding surface is raised to increase the thermal stress, thereby greatly promoting the oxidation of the bonding surface.

It becomes possible to increase the groove depth A if the thickness C of the alloy layer (stress-relieving layer) is increased. The reason for this is that when the thickness of the alloy layer increases, the thermal stress on the bonding surface is greatly relieved.

The optimum groove depth A is not less than $\frac{2}{3}$ of the noble metal tip layer thickness B when the thickness B of the noble metal tip layer 11 is any of 0.2 mm, 0.5 mm and 1.0 mm. The reason for this is thought to be that when the noble metal tip layer thickness B increases, the thermal stress on the bonding surface increases, so that cracks are liable to develop even in the thick tip layer. The oxidation of the bonding surface is slight before the groove depth reaches a specific value even when the noble metal tip layer thickness B is any of 0.2 mm, 0.5 mm and 1.0 mm. The reason for this is that although the thermal stress on the bonding surface increases with increase of the thickness of the noble metal tip layer as described above, the bonding surface is disposed closer to the substrate of the central electrode 1, so that the temperature of the bonding surface tends to be lowered, thereby decreasing the thermal stress on the bonding surface. As a result, it is thought that the oxidation of the bonding surface is made slight before the groove depth reaches the specific value.

As described above, in this embodiment, the groove 12 extended to the vicinity of the bonding surface between the noble metal tip layer 11 and the central electrode (base metal) having the noble metal tip layer 11 is formed in that surface of the central electrode 1 opposed to the earth electrode 8. As a result, when it is intended to increase the diameter of the tip layer, the thermal stress tends to increase at the bonding surface because of the configuration effect. Also, when it is intended to increase the diameter of the tip layer, the temperature at the bonding surface tends to be lowered, so that the thermal stress due to this temperature is decreased. And, because of the provision of the groove 12, the decrease of the thermal stress due to the temperature becomes ruling. Therefore, when it is intended to achieve a long service life by increasing the diameter of the noble metal tip layer 11, the disengagement of the noble metal tip layer 11 can be prevented by decreasing the thermal stress on the bonding surface.

In the type of spark plug in which the noble metal tip layer 11 is bonded to the central electrode 1 through the stress-relieving layer 10, and the cross-shaped groove 12 is formed in an end surface of the noble metal tip layer 11 opposed to the earth electrode 8, if the following relations are established optimum results can be achieved:

$2B/3 \leqq A \leqq B+0.3$ mm in the case of $0<C<0.01$ mm;

$2B/3 \leqq A \leqq B+0.7$ mm in the case of $0.01$ mm $\leqq C<0.05$ mm;

$2B/3 \leqq A \leqq B+0.8$ mm in the case of $0.05$ mm $\leqq C<0.02$ mm; and $2B/3 \leqq A \leqq B+0.9$ mm in the case of $0.2$ mm $\leqq C$ where A (mm) represents the depth of the groove 12, C (mm) represents the thickness of the stress-relieving layer 10, and B (mm) represents the thickness of the tip portion including the thicknesses of the stress-relieving layer 10 and if the nobel metal tip layer 11.

Second Embodiment

Figure 26:
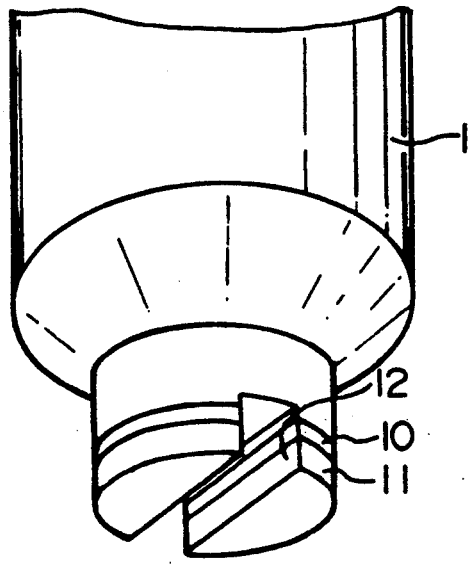
FIG. 26 is a perspective fragmentary view of a central electrode of a spark plug according to a second embodiment of the invention.

FIG. 26 shows a second embodiment of the invention. The spark plugs according to the first embodiment have the cross-shaped groove 12 as described above, but the second embodiment differs from the first embodiment in that there is provided a straight groove 12. The other construction of the second embodiment is the same as that of the first embodiment.

Third Embodiment

Figure 27:
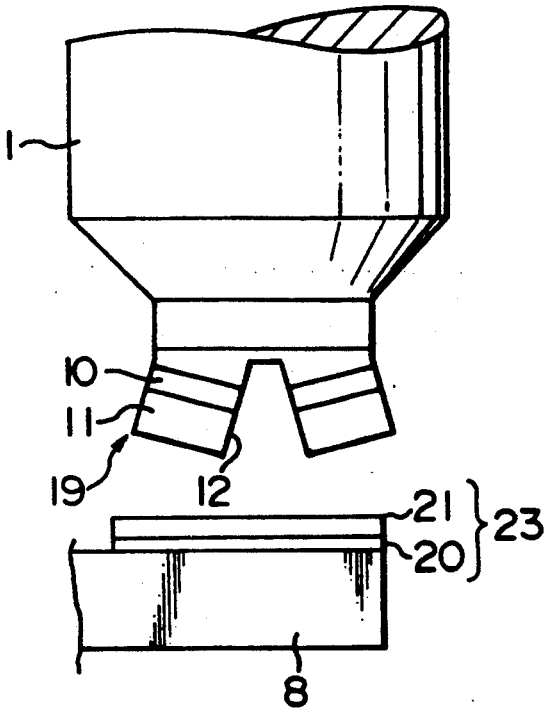
FIG. 27 is a fragmentary view of a distal end portion of a spark plug according to a third embodiment of the invention.
Figure 28:
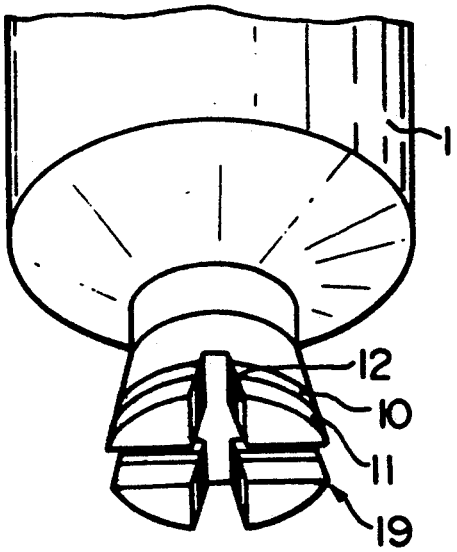
FIG. 28 is a perspective view showing a distal end portion of a central electrode shown in FIG. 27.

In the third embodiment shown in FIGS. 27 and 28, a tip portion 19 including a noble metal tip layer 11 and a stress-relieving layer 10 is flared in such a manner that the diameter of the tip portion 19 increases progressively toward an earth electrode 8, as shown in FIG. 27. The noble metal tip layer 21 is formed on the earth electrode 8 through the intermediary of a stress elaxation layer 21 so as to constitute a rectangular parallelepiped tip portion. This flared portion is divided by a cross-shaped groove (recess) 12 into a plurality of sections, and has a uniform cross-section area along an axial direction. The other construction is the same as that of the embodiment shown in FIGS. 1 to 3.

Figures 29A, 29B, 29C, 29D, 29E, 29F, 29G, 29H:
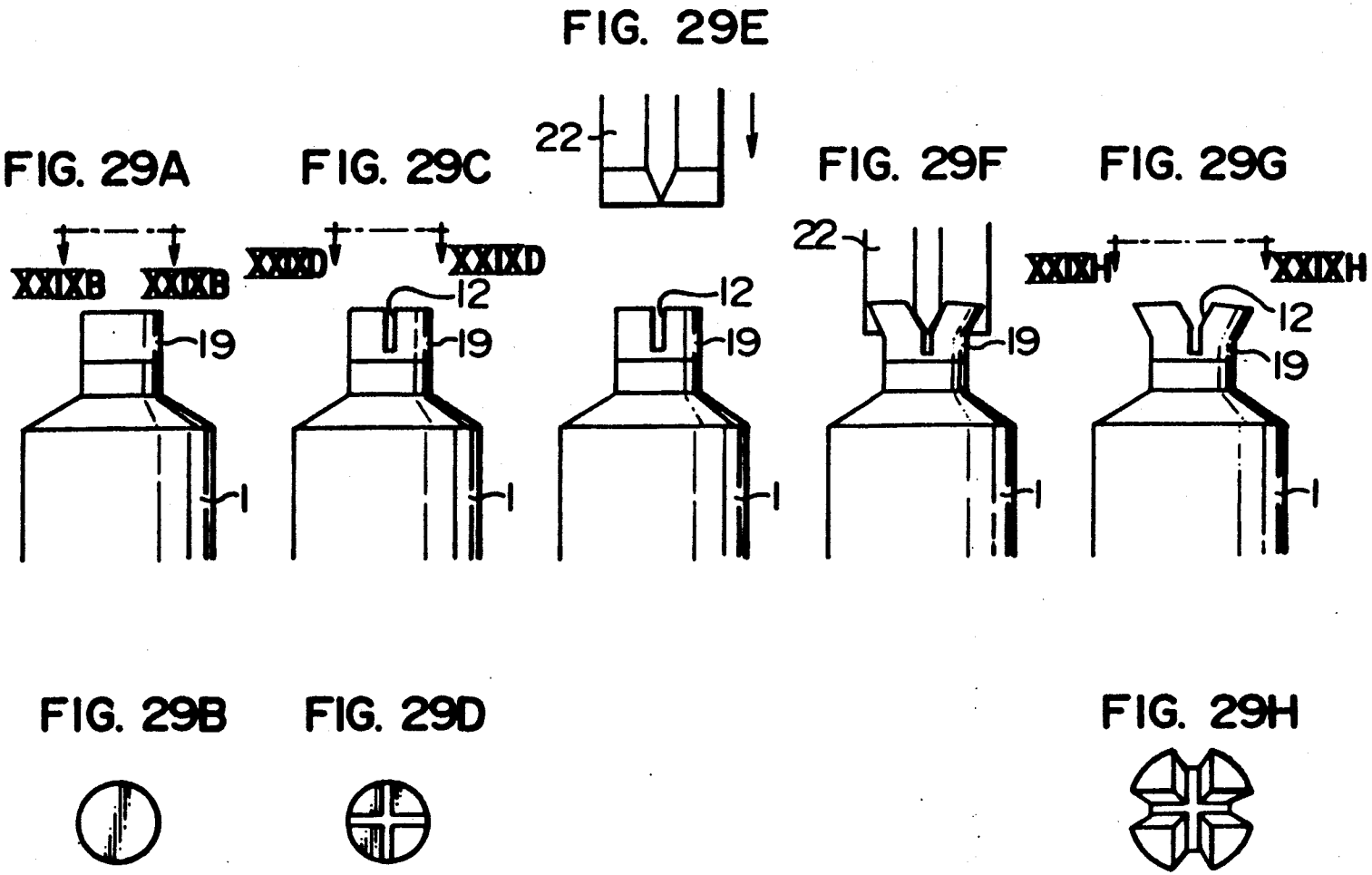
FIGS. 29A, 29B, 29C, 29D, 29E, 29F, 29G and 29H are views showing a process for forming the central electrode shown in FIG. 27.

FIGS. 29A to 29H show a method of forming the above-mentioned tip portion 19 on a central electrode 1. First, a cross-shaped slit 12 having a width of around 0.1 mm and a predetermined depth is formed in the distal end face of the cylindrical tip portion 19 (FIGS. 29A and 29B) by means of a cutter (rotary disk) made of boron nitride (BN), as shown in FIGS. 29C and 29D. Then, as shown in FIG. 29E, a cross-shaped dividing die (enlarging member) 22 having a wedge-shaped end is prepared. The dividing die 22 is disposed above the tip portion 19 to align with the slit 12. Then, as shown in FIG. 29F, the dividing die 22 is press-fitted into the slit 12 to widen the slit 12. Thereafter, the dividing die 22 is removed. As a result, the tip portion 19 is flared to form into an inverted conical shape with the cross-shaped groove 12, as shown in FIGS. 29G and 29H.

Figure 30:
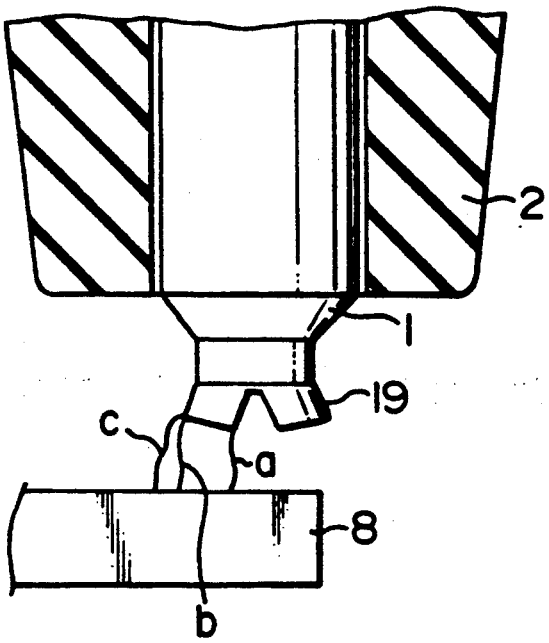
FIGS. 30 and 31 are views each showing a spark test.
Figure 31:
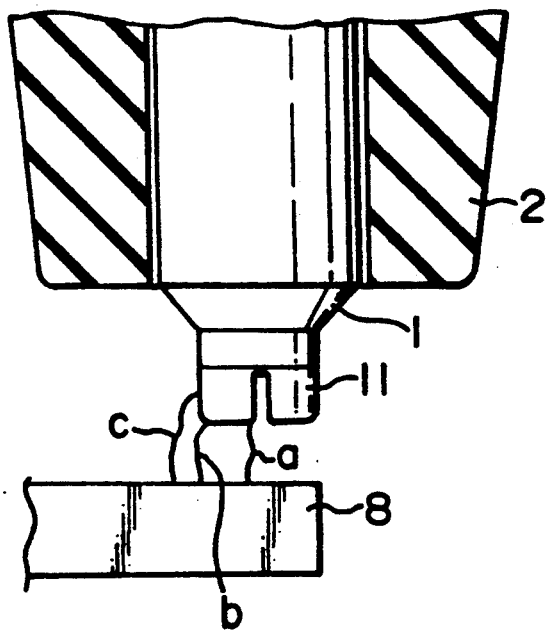

The following sparking test is carried out to observe the sparking conditions. Namely, the test is carried out to compare the spark plug of this embodiment (FIG. 30) with a spark plug (FIG. 31) having a cylindrical noble metal tip layer 11. As a result, it is found that a spark path a extending axially from the distal end face of the tip portion 19, a spark path b extending obliquely from the edge of the distal end, and a spark path c extending from the outer peripheral surface of the tip portion 19 are created. It is also found that the spark path c in the plug of this embodiment (FIG. 30) is shorter than a spark path c in the comparative plug (FIG. 31) corresponding to the plug of FIG. 1. This means that a lower discharge voltage is required.

Figure 34A:
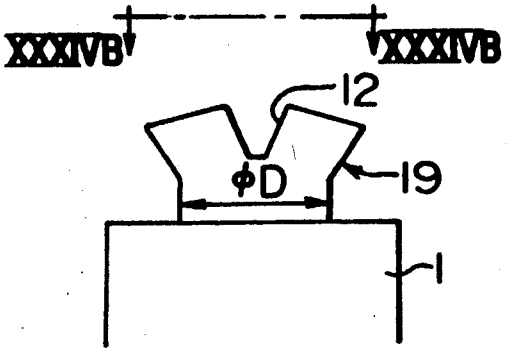
FIGS. 32A, 32B, 33A, 33B, 34A, and 34B are views respectively showing central electrodes of spark plugs used for tests.
Figure 34B:
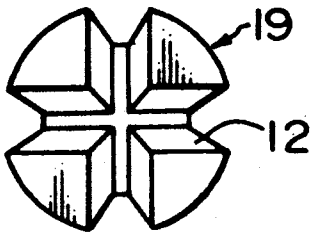
Figure 33A:
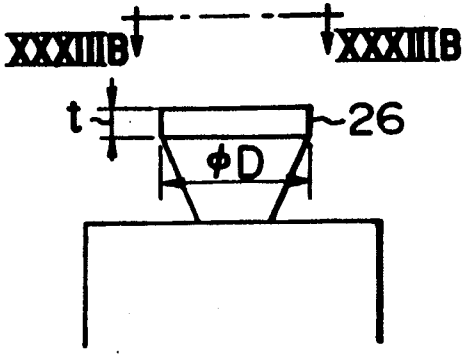
Figure 33B:
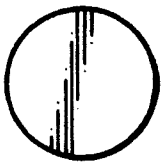

Next, there are prepared three kinds of spark plugs. Namely, the plug shown in FIGS. 32A and 32B (hereinafter referred to as "cross groove-type") had a cylindrical noble metal tip 24 having a cross-shaped groove 25. The plug shown in FIGS. 33A and 33B (hereinafter referred to as "inverted taper-type") had a noble metal tip 26 having a cylindrical portion of a predetermined thickness t at its distal end and an invertedly tapered (inverted coneshaped) proximal portion. The plug shown in FIGS. 34A and 34B (hereinafter referred to as "crown-type") had a noble metal tip 19 as in this embodiment. The outer diameter D of the central electrode of the cross groove-type, the outer diameter D of the central electrode of the inverted taper-type and the outer diameter D of the central electrode of the crown-type before flaring are the same, that is, 1.5 mm. These noble metal tips are made of a platinum alloy.

Figure 35:
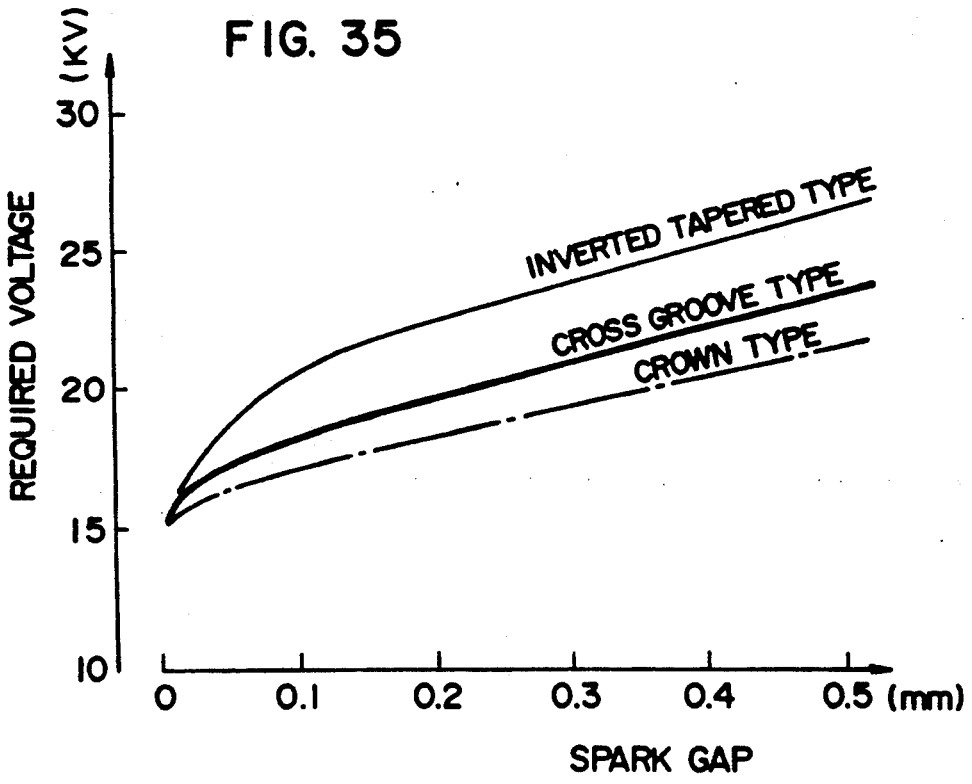
FIG. 35 is a graph showing the relation between the amount of increase of a spark gap and a required voltage.

The relations between the spark gas and the required voltage are determined by tests in connection with the above three kinds of plugs. The results thereof are shown in FIG. 35. In FIG. 35, the abscissa axis represents the spark gap, and the ordinate axis represents the required voltage. Since there are variations in the required voltage, the maximum value thereof is employed as the required voltage.

As can be seen from FIG. 35, in the order of increasing the required voltage as the spark gas increases, there are the crown-type, the cross groove-type and the inverted taper-type. This is thought to be achieved by the combination of the various effects, such as diametrical division of the electrode by the cross-shaped groove into the small sections, the temperature rise due to the reduced cross-section, the required voltage reduction design due to the extended edge portion, and the shortened discharge length due to the invertedly tapered-shaped.

Figure 32A:
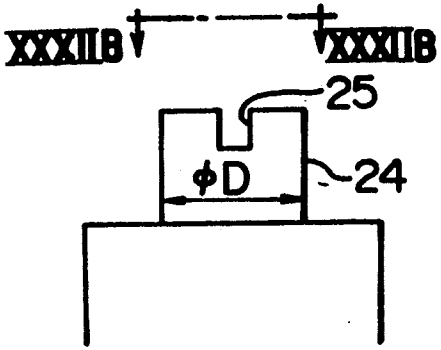
Figure 32B:
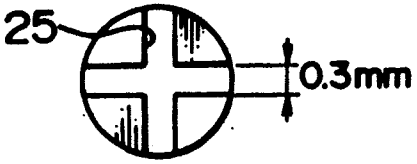
Figure 36:
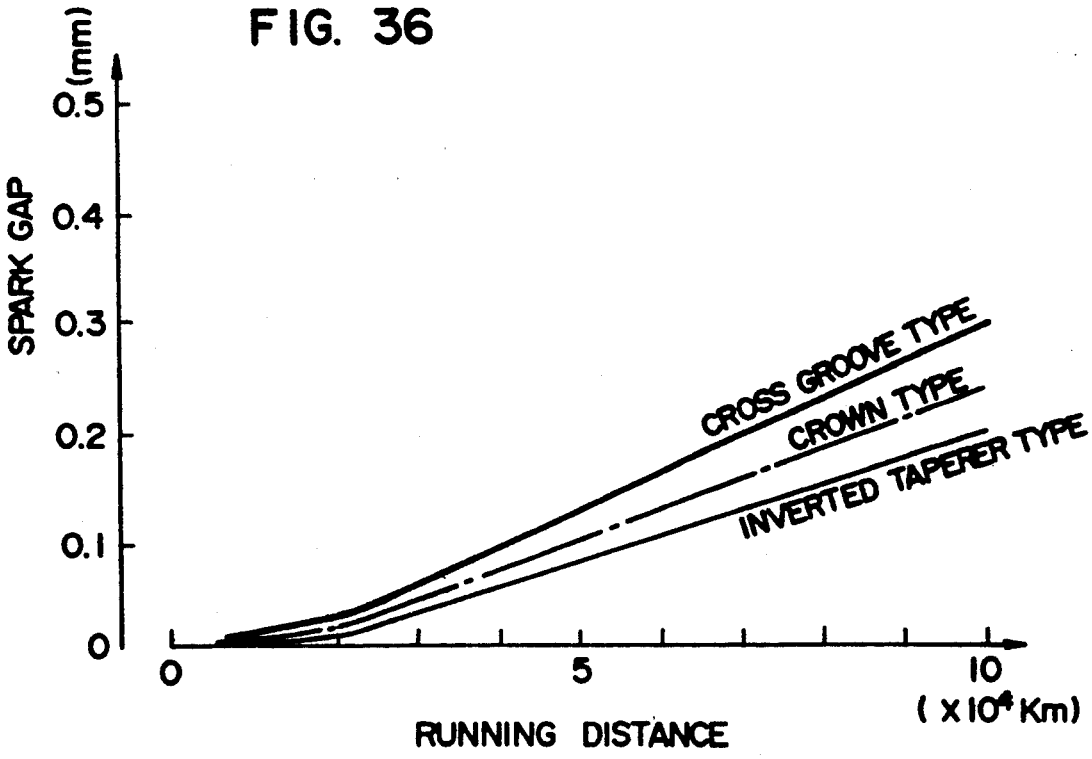
FIG. 36 is a graph showing the relation between a running distance and the amount of increase of the spark gap.

In FIG. 35, the abscissa axis represents the spark gap. However, in the case of actually using the spark plug, the amount of the spark gap relative to the running distance in the actual running is a major factor in finally deciding the required voltage. Therefore, the test for this purpose is also carried out. The results thereof are shown in FIG. 36 in which the abscissa axis represents the running distance, and the ordinate axis represents the spark gap. As can be seen from FIG. 36, in the order of increasing the consumption of the electrode there are the inverted taper-type, the crown-type and the cross groove-type. The cross-shaped groove 25 in the cross groove-type has the width of not less than 0.3 mm as shown in FIGS. 32A and 32B. Therefore the effective cross-sectional area is the smallest, and then the consumption is large. In the crown-type, the slit having the width of not more than 0.3 mm is enlarged or widened. Therefore the effective cross-sectional area is larger than that of the cross groove-type, and then the consumption is small. Also, the crown-type is almost equal in cross-sectional area to the inverted taper-type, and therefore the amount of increase of the spark gap in the crown-type is close to that of the inverted taper-type.

Figure 37:
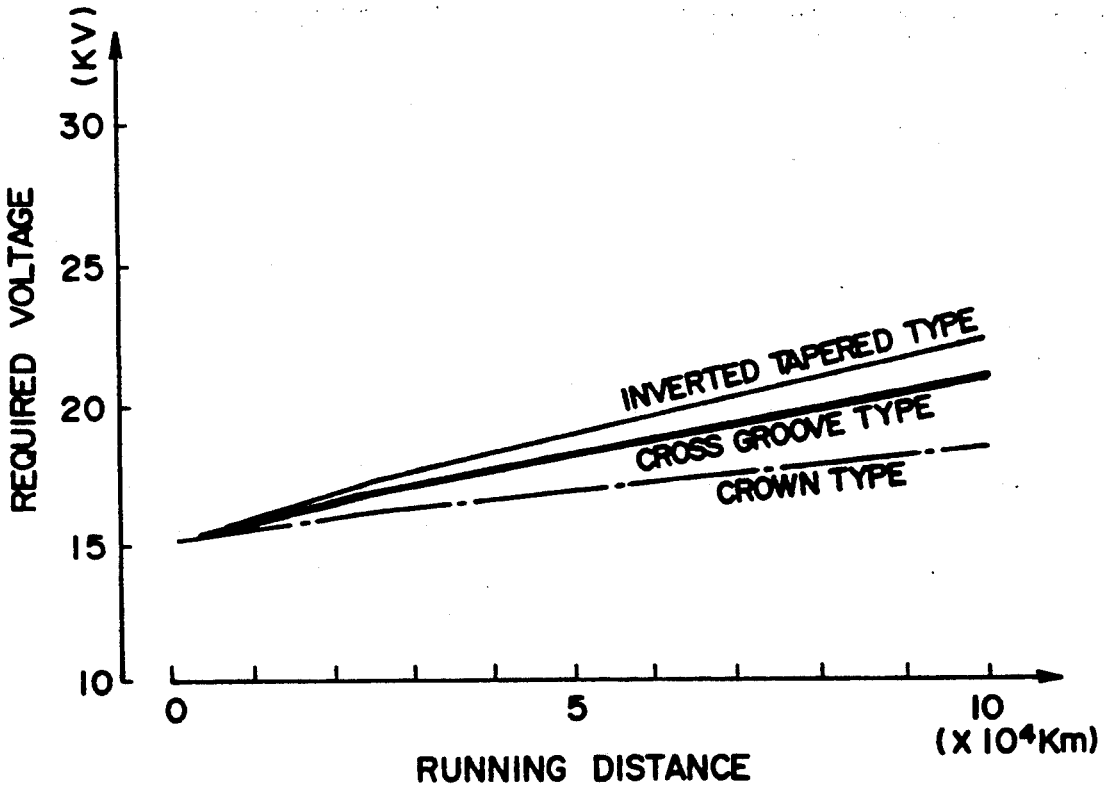
FIG. 37 is a graph showing the relation between the running distance and the required voltage.

The relation between the running distance and the required voltage can be obtained from the relations shown in FIGS. 35 and 36, and this is shown in FIG. 37. It will be appreciated from FIG. 37 that the crown-type requires the lowest voltage and is most excellent.

Figure 38:
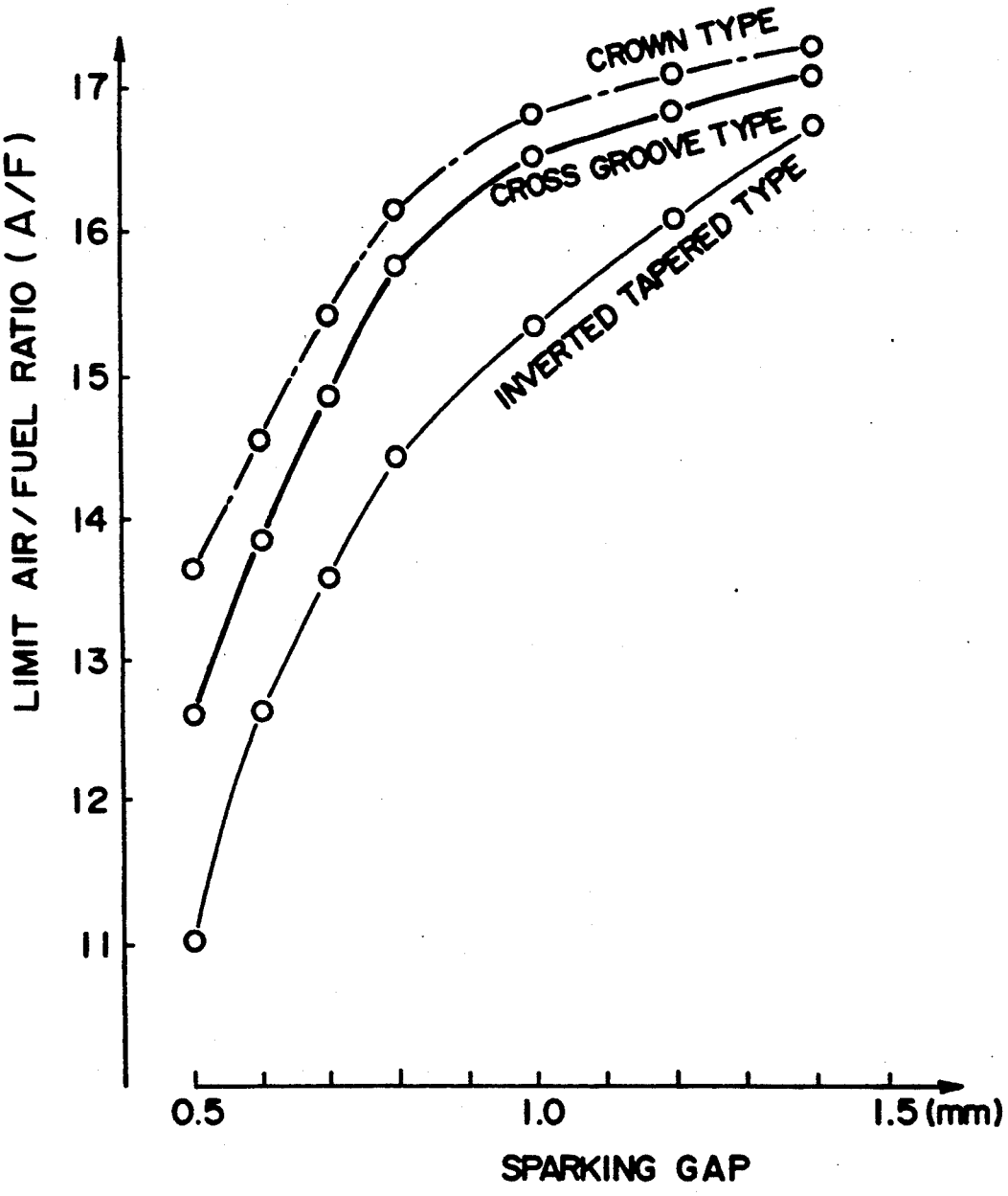
FIG. 38 is a graph showing the relation between the spark gap and a limit air/fuel ratio.

Further, flame-suppressing effects of the inverted taper-type plug, the crown-type plug and the cross groove-type plug are examined by tests. These tests are carried out under the conditions that these plugs are mounted on an engine with a displacement of 2000 cc and ignited at BTDC of 10° at an idling speed of 600 rpm. The results thereof are shown in FIG. 38 is which the abscissa axis represents the spark gap, and the ordinate axis represents the limit air/fuel ratio. As is clear from FIG. 38, the flame core can be easily formed in the crown-type because the discharge portion is greatly enlarged, and the crown-type had a better ignitability than the cross groove-type.

As described above, in the embodiment shown in FIGS. 34A and 34B, the distal end portion of the central electrode 1 (i.e., the noble metal tip portion 19) is flared in such a manner that the diameter of the noble metal tip portion 19 increases progressively toward the earth electrode. The cross-shaped groove (recess) 12 is formed to open to the distal end face of the tapered portion and the flared portion has a uniform cross-section area in the axial direction. As a result, the discharge concentrates on the edge portion of the central electrode 1, and the electrode is consumed in the axial direction from the edges of the end face of the flared portion and the edges of the cross-shaped groove 12. The discharge along the long discharge path extending from the outer peripheral surface of the flared portion is suppressed, and the required voltage is suppressed. Further, since the flared portion has a uniform cross-sectional area in the axial direction, the consumption of the electrode in the axial direction is retarded. Therefore, the consumption of the electrode can be suppressed, and at the same time the required voltage can be decreased.

Figure 39:
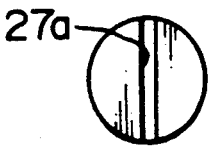
FIGS. 39, 40, 41 and 42 are bottom views showing central electrodes of modified spark plugs, respectively.
Figure 40:
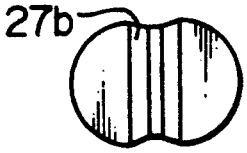

In this embodiment, the cross-shaped groove 12 is formed in the distal end face of the noble metal tip portion 19 on the distal end of the central groove 1. This spark plug may be modified. For example, a straight slit 27*a* is formed as shown in FIG. 39, and then the slit 27*a* is widened to form a groove 27*b*, as shown in FIG. 40.

Figure 41:
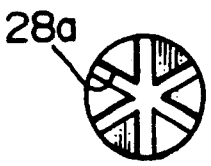
Figure 42:
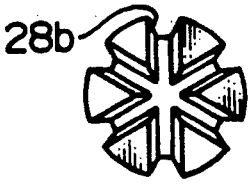

As another example, there are formed three slats 28a intersecting at the center of the noble metal tip portion as shown in FIG. 41, and then the slits 28a are widened to form grooves 28b, as shown in FIG. 42. In the embodiment shown in FIGS. 34A and 34B, although the groove (cross-shaped groove 12) is so formed as to divide the noble metal tip portion 19, the groove does not always need to divide the noble metal tip portion (that is, extend diametrically to the outer peripheral surface of the noble metal tip portion), and the groove may extend on a part of the distal end face of the tip portion, opposed to the earth electrode 17.

Figure 43C:
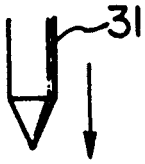
FIGS. 43A, 43B, 43C, 43D and 43E are views showing a modified process for forming the central electrode.
Figure 43A:
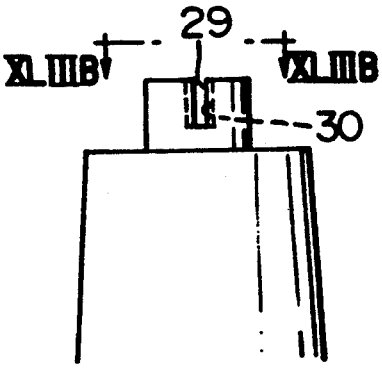
Figure 43A:
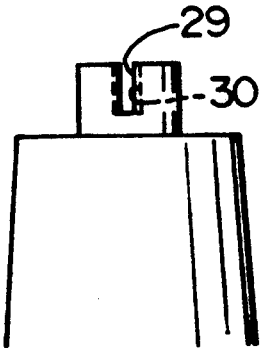
Figure 43D:
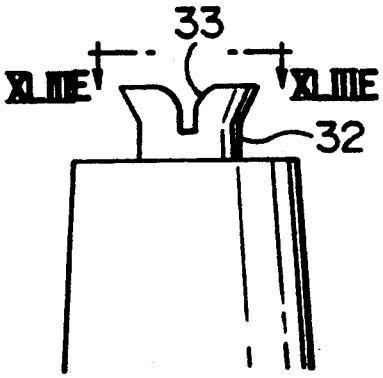
Figure 43B:
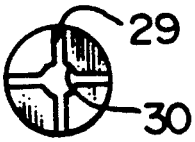
Figure 43E:
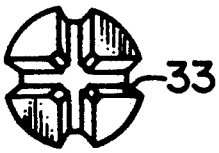

The diameter of the distal end portion of the central electrode may be enlarged in a manner shown in FIGS. 43A to 43E. More specifically, a cross-shaped slits 29 are formed, and a cylindrical recess 30 is formed in the intersection portion of the slits 29 (FIG. 43B), and then a dividing die 31 (enlarging member) having a cylindrical shape and a pointed end is press-fitted into the recess 30 to forcibly widen the slits 29, as shown in FIG. 43C. According this a groove 33 is formed, thereby enlarging the diameter of the distal end portion of the central electrode 32, as shown in FIGS. 43D and 43E.

In the above-mentioned embodiment, the explanation has been made of the plug provided with a noble metal chip. However the concept of the present invention can be also applied to a spark plug which is made of a nickel group material, having a center electrode whose tipend diameter is about 2.5 mm.

Though the earth electrode may be made of either of noble metal and other metal, it is preferred from the viewpoint of electrode consumption that a tip (preferably made of noble meal) having a diameter corresponding to the outer diameter of the discharge portion of the central electrode should be bonded to the earth electrode.

Fourth Embodiment

A fourth embodiment of the invention will now be described. This embodiment is intended to improve the above third embodiment, and more specifically this embodiment is intended to decrease the required voltage while suppressing the consumption of the electrode, and also to improve the ignitability. An earth electrode is also improved.

This embodiment provides such constructions as shown in FIGS. 45 to 48, in contrast with a conventional spark plug (FIG. 44) having a central electrode 34 of a cylindrical shape. In the plug shown in FIG. 45, the diameter D1 of the distal end face of a central electrode 35 is greater than the width W1 of an earth electrode 36 opposed thereto. In the plug shown in FIG. 46, the axis L1 of a central electrode 37 is displaced or offset a distance δ from the center line L2 of an earth electrode 38 opposed thereto. In the plug shown in FIG. 47, a noble metal tip 41 is bonded to project from the surface of an earth electrode 40 opposed to a central electrode 39. Further, in a plug shown in FIG. 48, a straight groove 44 is formed in an earth electrode 43 opposed to a central electrode 42.

The ignition performance of a spark plug depends on the growth of a flame core formed by a discharge produced by the spark gap. The growth of the flame core is unstagble at a light load such as the idling, and the combustion temperature is low. Therefore, the temperatures of the central electrode and earth electrode forming the spark gap are also low, and then the flame-suppressing effect is encountered. When a large flame-suppressing effect is encountered, the flame core disappears or is retarded in growth, thus causing a problem that the combustion of the engine becomes unstable. Also, the flame core is formed in the spark gap, and grows along the flow of the air/fuel mixture, and therefore the ignitability is adversely affected in some direction due to the flame-suppressing effects of the central electrode and the earth electrode in accordance with the mounting of the spark plug.

Figure 49:
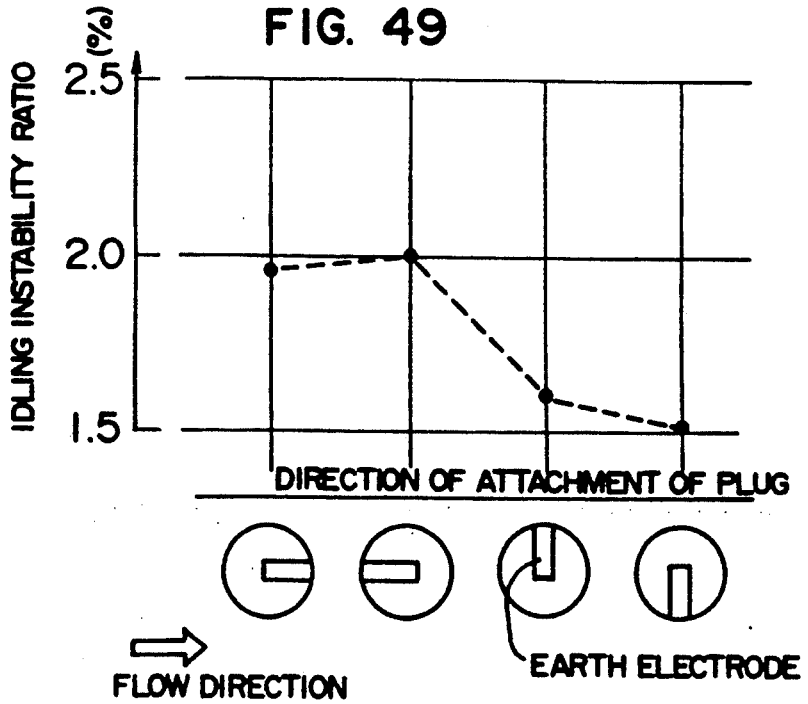
FIG. 49 is a graph showing the influence of a spark plug attachment direction on the ignitability.
Figure 50A:
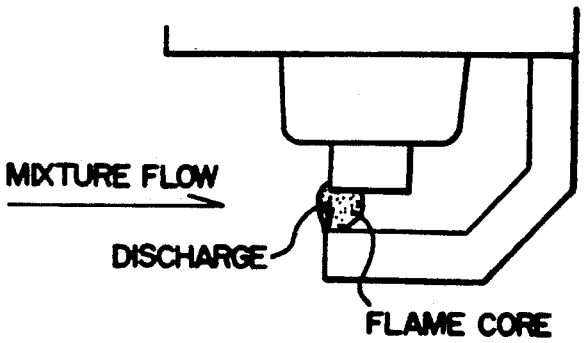
FIGS. 50A and 50B are views showing the flow of air/fuel mixture and the growth of a flame core.
Figure 50B:
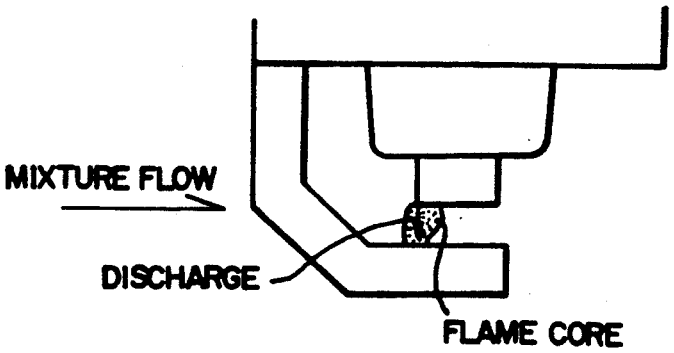

FIG. 49 shows results of the influences of the earth electrode direction and the air/fuel mixture flow direction on the ignitability, and evaluations are made on an ordinary spark plug with a spark gap of 0.8 mm. A four-cycle petrol engine with a displacement of 1600 cc is operated at an idling speed of 600 rpm at BTDC of 17° at the air/fuel ratio of 14, and rotation speed variations are measured at an interval of 0.2 seconds for 3 minutes, and the instability ratio (i.e., the ratio of rotation speed variations to the average rotation speed) is measured. In the mounting direction of the spark plug in which the air/fuel mixture flow is blocked or interrupted by the earth electrode, the ignitability is adversely affected. It is though of that because the flame core is confined in the spark gap during the growth of the flame core as shown in FIGS. 50A and 50B, so that the flame-suppressing effects of the electrodes act greatly.

Figure 44:
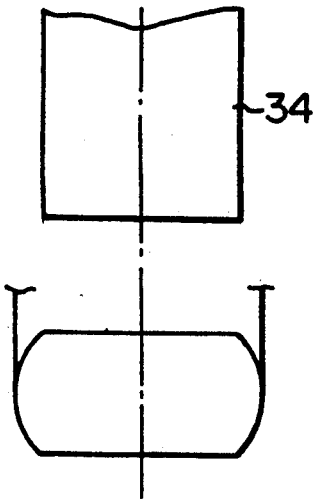
FIGS. 44, 45, 46, 47, and 48 are views of distal end portions of spark plugs.
Figure 45:
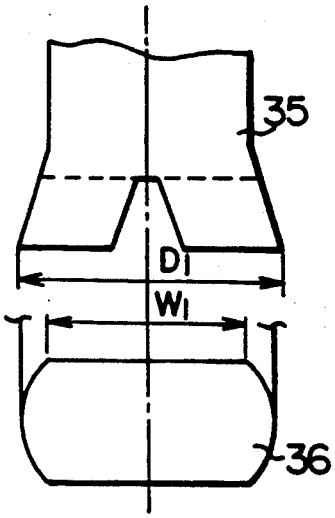
Figure 51:
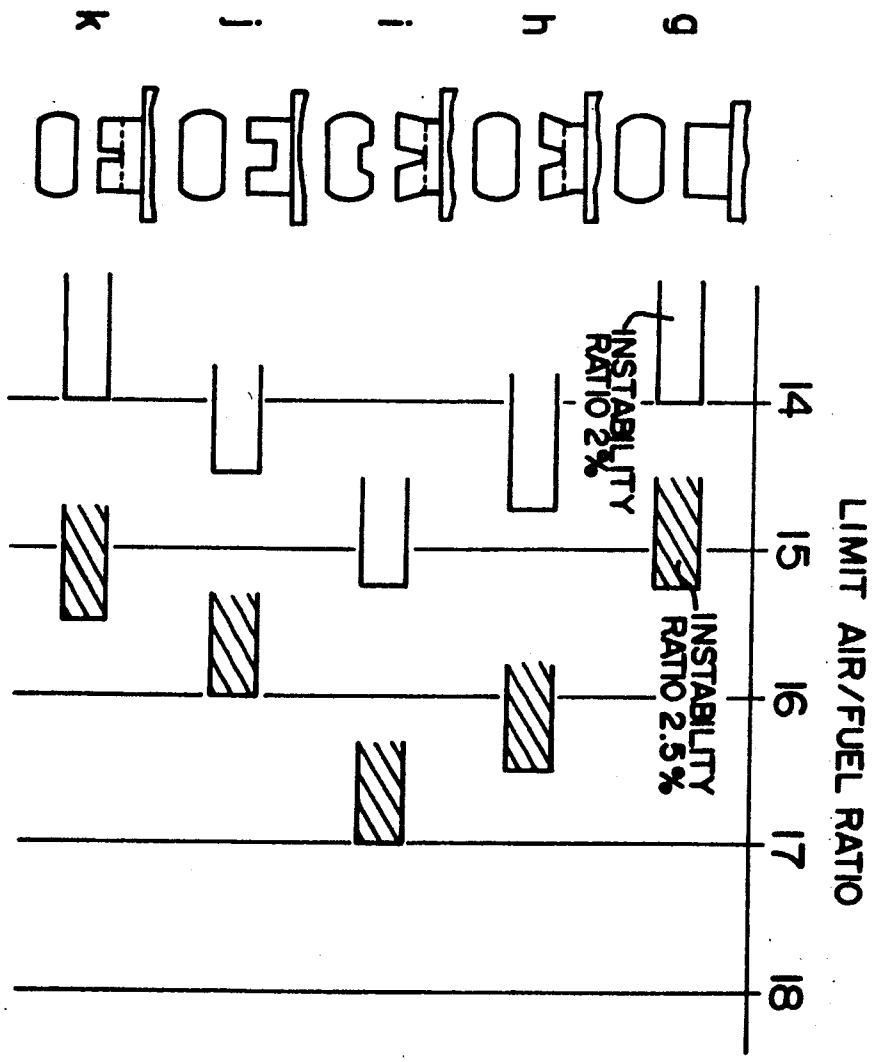
FIGS. 51, 52 and 53 are graphs in which the idling instability ratios are compared in terms of the air/fuel ratio.
Figure 52:
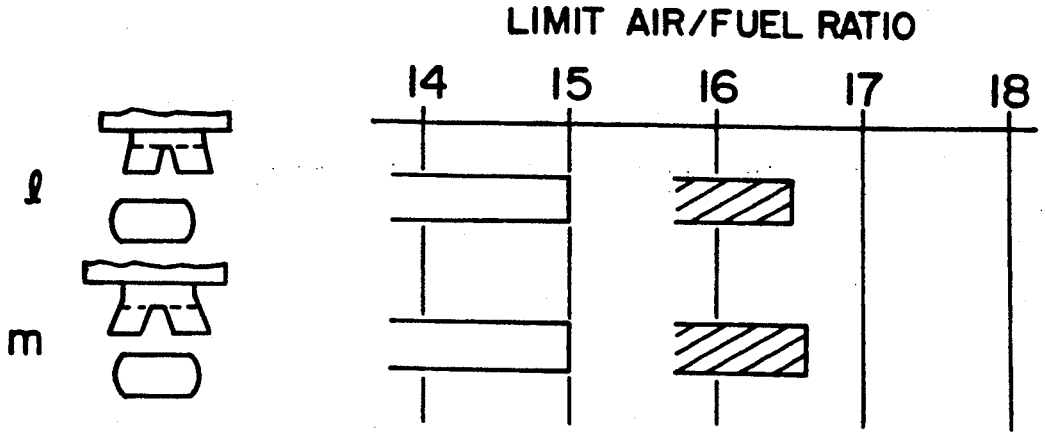
Figure 53:
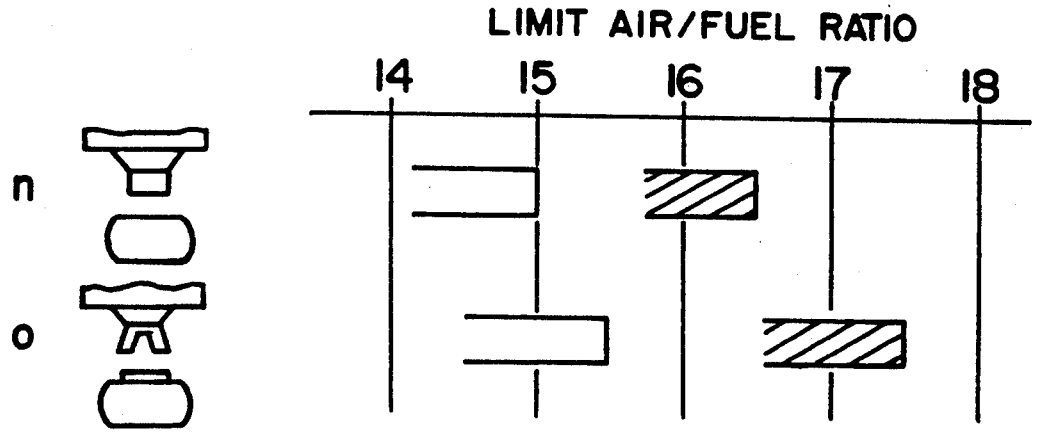

In FIGS. 51 to 53, those air/fuel ratios in which the instability ratio became 2% and 2.5% are determined, using a four-cycle petrol engine with a displacement of 1600 cc operated at an idling speed of 600 rpm. at BTDC of 17°. Each plug is mounted in such that the earth electrode blocked the air/mixture flow. The plug has the central electrode having an outer diameter of 2.5 mm. In FIG. 51, the plug (g) is of the conventional type as shown in FIG. 44; the plug (h) is one corresponding to that of FIG. 45, in which a groove having a depth of 1.0 mm and a width of 0.15 mm is formed in the distal end face of a central electrode, and the width of this groove is increased to 0.5 mm; the plug (i) is one corresponding to that of FIG. 48, in which a straight groove is formed in the earth electrode; the plug (j) is one (as disclosed in U.S. Pat. No. 4,336,477) in which a groove having a depth of 0.5 mm and a width of 1.0 mm is formed in the distal end face of a central electrode; and the plug (k) is one (as disclosed in Japanese Patent Examined Publication No. 33946/84) in which a groove having a depth of 1.0 mm and a width of 0.3 mm is formed in the distal end face of a central electrode.

Figure 46:
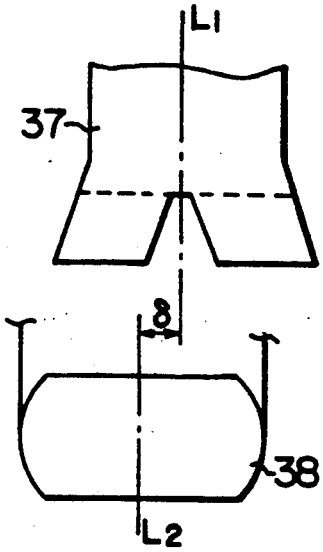

In FIG. 52, the plug (l) is one corresponding to that of FIG. 46, in which a groove having a depth of 1.0 mm and a width of 0.15 mm is formed in the distal end face of a central electrode, and the width of this groove is increased to 0.5 mm, and further the center line of an earth electrode is displaced by 0.3 mm from the axis of the central electrode, and the plug (m) is one in which the distal end portion of the central electrode of the plug (h) in FIG. 51 is further enlarged, and a groove having a depth of 1.0 mm and a width of 0.15 mm is formed in the distal end face of the central electrode, and the width of this groove is increased to 1.0 mm.

Figure 47:
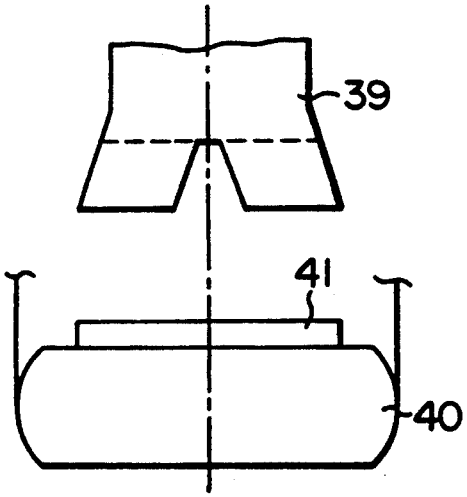
Figure 48:
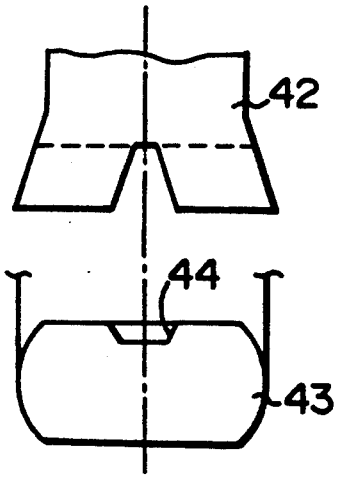

In FIG. 53, the plug (n) is a conventional platinum plug having a central electrode having an outer diameter of 1.1 mm, and the plug (o) is one corresponding to that of FIG. 47, in which a groove having a depth of 0.6 mm and a width of 0.2 mm is formed in a central electrode having a platinum tip layer having an outer diameter of 1.3 mm, and further a platinum alloy tip having a diameter of 1.8 mm was welded to the surface of an earth electrode, opposed to the central electrode, to project by 0.1 mm from the earth electrode surface to define a spark gap of 0.8 mm.

As is clear from FIGS. 51 to 53, in the plugs of the present invention as in contrast with the conventional plugs (g), (j) and (k) in FIG. 51, the air/fuel ratio is shifted toward the lean side with respect to both the instability ratio of 2% and the instability ratio of 2.5%, and thus it has been confirmed that the ignitability is improved. This is because the flame core growth-space which is not influenced by the flow of the air/fuel mixture is positively obtained.

Thus, it is possible to achieve a high compression by decreasing the spark voltage, without adversely affecting the durability of the spark plug, and even in the low rotation speed region as in the idling speed, a stable combustion can be achieved regardless of the direction of attachment of the spark plug, and also the engine can be operated with a lean air/fuel mixture.

In the present invention, a plurality of noble metal tip pieces may be so bonded to the distal end face of the central electrode that they are separated from one another, but adjacent to one another.

In FIG. 1, the groove 12 may, of course, terminate at the boundary between the stress-relieving layer 10 and the central electrode 1.

The groove 12 may have a U-shaped cross-section or a V-shaped cross-section. The material of the noble metal tip layer 11 is not limited to a platinum alloy, and may be made of a material containing noble metal as a main component. In the above embodiments, although the noble metal tip layer is provided on the central electrode 1 via the stress-relieving layer 10, this may be applied to the earth electrode, that is, the noble metal tip layer may be formed on the earth electrode via the stress-relieving layer. Further, the noble metal tip layer may be provided on each of the central electrode 1 and the earth electrode 8 via the stress-relieving layer.

What is claimed is:

1. A spark plug for use in an internal combustion engine comprising:

a pair of electrodes each made of base metal;

a noble metal tip portion provided on one of said electrodes to define a spark discharge gap between said noble metal tip portion and the other one of said electrodes; and recess means formed in a surface of said noble metal tip portion defining said spark discharge gap, and diametrically extending to divide said noble metal tip portion into a plurality of section, wherein said noble metal tip portion includes a tip layer made of noble metal, and a thermal stress-relieving layer disposed between said noble metal tip layer and said one electrode, and wherein said recess means axially extend to said one electrode.

2. A spark plug according to claim 1, wherein said recess means have a cross shape in a plan view.

3. A spark plug according to claim 1, wherein a composition of said thermal stress-relieving layer is substantially identical to that of alloy of the noble metal of said noble metal tip portion and the base metal of said electrodes.

4. A spark plug according to claim 3, wherein said thermal stress-relieving layer is an alloy layer which is made by melting said one electrode and said noble metal tip layer.

5. A spark plug according to claim 1, wherein a depth A of said recess means, a thickness B of said noble metal tip layer, and a thickness C of said thermal stress-relieving layer satisfy the following relations:

$$\frac{1}{2}B\ \text{mm} \leqq A\ \text{mm} \leqq B+0.3\ \text{mm}$$

in case of 0 mm<C mm<0.01 mm;

$$\frac{1}{2}B\ \text{mm} \leqq A\ \text{mm} \leqq B+0.7\ \text{mm}$$

in case of 0.01 mm≦C mm<0.05 mm;

$$\frac{1}{2}B\ \text{mm} \leqq A\ \text{mm} \leqq B+0.8\ \text{mm}$$

in case of 0.05 mm≦C mm<0.2 mm; and $$\frac{1}{2}B\ \text{mm} \leqq A\ \text{mm} \leqq B+0.9\ \text{mm}$$

in case of 0.2 mm≦C mm.

6. A spark plug as in claim 1, wherein said recess means is formed as a set of continuous inner surfaces extending through said noble metal tip portion to said one electrode.

7. A spark plug as in claim 1, wherein said recess means extends only a part of the way through said noble metal tip portion, and not all the way to said one electrode.

8. A spark plug as in claim 7, wherein cracks are formed extending from said recess means to said electrode.

9. A spark plug for use in an internal combustion engine comprising:

a central electrode made of a base metal;

an earth electrode;

a noble metal tip layer provided on said central electrode to define a spark discharge gap between said noble metal tip layer and said earth electrode;

an alloy layer provided between said noble metal tip layer and said central electrode; and groove means formed in a surface of said noble metal tip layer defining said spark discharge gap, said groove means axially extending to said central electrode and diametrically extending to divide said noble metal tip layer into a plurality of sections.

10. A spark plug according to claim 9, wherein a depth A of said groove means, a thickness B of said noble metal tip layer, and a thickness C of said alloy layer satisfy the following relations:

$$\frac{1}{2}B\ \text{mm} \leqq A\ \text{mm} \leqq B+0.3\ \text{mm}$$

in case of 0 mm<C mm<0.01 mm;

$$\frac{1}{2}B\ \text{mm} \leqq A\ \text{mm} \leqq B+0.7\ \text{mm}$$

in case of 0.01 mm≦C mm<0.05 mm;

$$\frac{1}{2}B\ \text{mm} \leqq A\ \text{mm} \leqq B+0.8\ \text{mm}$$

in case of 0.05 mm≦C mm<0.2 mm; and $$\frac{1}{2}B\ \text{mm} \leqq A\ \text{mm} \leqq B+0.9\ \text{mm}$$

in case of 0.2 mm≦C mm.

11. A spark plug according to claim 9, wherein said recess means have a cross shape in a plan view.

12. A spark plug according to claim 9, wherein said alloy layer is made by melting said central electrode and said noble metal tip layer.

13. The spark plug as in claim 9, wherein said recess means is formed as a set of continuous inner surfaces extending through said noble metal tip portion to said one electrode.

14. A spark plug as in claim 9, wherein said recess means extends only a part of the way through said noble metal tip portion, and not all the way to said one electrode.

15. A spark plug as in claim 14, wherein cracks are formed extending from said recess means to said electrode.

16. a central electrode made of a base metal;

a central electrode made of a base metal;

an earth electrode;

a tip portion provided on said central electrode to define a spark discharge gap between said tip portion and said earth electrode, said tip portion having an outer peripheral wall flared towards said earth electrode; and recess means formed in a surface of said tip portion defining said spark discharge gap, said recess means axially extending to said central electrode beyond said alloy layer and diametrically extending to divide said tip portion into a plurality of sections, and a width of said recess means gradually increasing from a bottom thereof to said surface.

17. A spark plug according to claim 16, wherein said tip portion includes a tip layer made of noble metal, and a thermal stress-relieving layer disposed between said noble metal tip layer and said central electrode.

18. A spark plug according to claim 17, wherein a composition of said thermal stress-relieving layer is substantially identical to that of alloy of the noble metal of said noble metal tip layer and the base metal of said central electrode.

19. A spark plug according to claim 18, wherein said thermal stress-relieving layer is made by melting said central electrode and said noble metal tip layer.

20. A spark plug according to claim 16, wherein said recess means have a cross shape in a plan view.

21. A spark plug according to claim 16, wherein said earth electrode is disposed to axially oppose to said central electrode.

22. A spark plug for use in an internal combustion engine comprising:

a central electrode made of a base metal;

an earth electrode; and a tip portion provided on said central electrode to define a spark discharge gap between said tip portion and said earth electrode, said tip portion being divided at a surface thereof defining said spark discharge gap into a plurality of sections which are separated from one another through space, but adjacent to one another, wherein said tip portion includes a tip layer made of noble metal, and a thermal stress-relieving layer disposed between said noble metal tip layer and said central electrode, and wherein a depth A of said space, a thickness B of said noble metal tip layer, and a thickness C of said thermal stress-relieving layer satisfy the following relations:

$$\frac{1}{2}B\ \text{mm} \leqq A\ \text{mm} \leqq B+0.3\ \text{mm}$$

in case of 0 mm<C mm<0.01 mm;

$$\frac{1}{2}B\ \text{mm} \leqq A\ \text{mm} \leqq B+0.7\ \text{mm}$$

in case of 0.01 mm≦C mm<0.05 mm;

$$\frac{1}{2}B\ \text{mm} \leqq A\ \text{mm} \leqq B+0.8\ \text{mm}$$

in case of 0.05 mm≦C mm<0.2 mm; and $$\frac{1}{2}B\ \text{mm} \leqq A\ \text{mm} \leqq B+0.9\ \text{mm}$$

in case of 0.2 mm≦C mm.

23. A spark plug according to claim 22, wherein a composition of said thermal stress-relieving layer is substantially identical to that of alloy of the noble metal of said noble metal tip layer and the base metal of said central electrode.

24. A spark plug according to claim 22, wherein said thermal stress-relieving layer is made by melting said central electrode and said noble metal tip layer.

25. A spark plug according to claim 22, wherein said earth electrode is disposed to axially oppose to said central electrode.

26. A spark plug according to claim 22, wherein said tip portion is divided into four pieces and said space represents a cross shape.

27. A spark plug for use in an internal combustion engine comprising:

a central electrode defining an axis therealong;

an earth electrode disposed on axis of said central electrode to oppose said central electrode, thereby defining therebetween a spark discharge gap therebetween;

a flared portion formed on an end portion of said central electrode, said flared portion being flared towards said earth electrode; and recess means opened in an end surface of said flared portion, said recess means being so dimenisioned that a cross-sectional area of said flared portion is constant along an axis of said flared portion.

28. A spark plug as in claim 27, wherein said recess means is in the shape of a straight, flat-sided slit.

29. A spark plug as in claim 27, wherein said recess means is in the shape of a straight slit which widens towards said end surface.

30. A spark plug as in claim 27, wherein said recess means is formed of three intersecting slits.

31. A spark plug as in claim 30, wherein said three slits are widened toward said end surface to form tilted side slits.

32. A spark plug as in claim 27, wherein said recess means is formed of two intersecting grooves.

33. A spark plug as in claim 32, wherein said intersecting grooves are widened toward said end surface.

* * * * *